US008739712B2

(12) United States Patent
Kawaguchi et al.

(10) Patent No.: US 8,739,712 B2
(45) Date of Patent: Jun. 3, 2014

(54) PUNCH DATA GENERATING DEVICE AND COMPUTER READABLE MEDIUM STORING PUNCH DATA GENERATING PROGRAM

(75) Inventors: Yasuhiko Kawaguchi, Nagoya (JP); Yukiyoshi Muto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 968 days.

(21) Appl. No.: 12/852,798

(22) Filed: Aug. 9, 2010

(65) Prior Publication Data

US 2011/0056421 A1 Mar. 10, 2011

(30) Foreign Application Priority Data

Sep. 7, 2009 (JP) ..... 2009-205823
Sep. 7, 2009 (JP) ..... 2009-205824

(51) Int. Cl.
*D05B 19/00* (2006.01)

(52) U.S. Cl.
USPC ..... 112/470.01; 700/138

(58) Field of Classification Search
USPC ..... 112/102.5, 222, 470.01, 470.04, 112/470.06, 475.17–475.19; 700/136–138
See application file for complete search history.

(56) References Cited

U.S. PATENT DOCUMENTS 4,640,529 A * 2/1987 Katz ..... 281/5
5,740,055 A * 4/1998 Iwata ..... 112/475.19
5,778,807 A * 7/1998 Nishizawa et al. ..... 112/470.06
5,880,963 A * 3/1999 Futamura ..... 700/138
7,467,535 B2 12/2008 Kuno et al.
8,272,341 B2 * 9/2012 Konig et al. ..... 112/89
2008/0229988 A1 * 9/2008 Kishi ..... 112/102.5
2009/0107373 A1 * 4/2009 Niizeki ..... 112/102.5
2010/0050915 A1 * 3/2010 Konig et al. ..... 112/475.18

FOREIGN PATENT DOCUMENTS

| | | |
|---|---|---|
| JP | A 5-096071 | 4/1993 |
| JP | A 6-155383 | 6/1994 |
| JP | U 7-042683 | 8/1995 |
| JP | A 11-172566 | 6/1999 |
| JP | A 2007-008133 | 1/2007 |

OTHER PUBLICATIONS

Jul. 18, 2013 Office Action issued in U.S. Appl. No. 12/710,034.
U.S. Appl. No. 12/710,034, filed Feb. 22, 2010 in the name of Kawaguchi et al.

* cited by examiner

*Primary Examiner* — Nathan Durham
(74) *Attorney, Agent, or Firm* — Oliff PLC

(57) ABSTRACT

A punch data generating device is disclosed that generates punch data for execution with an embroiderable sewing machine including a needle bar allowing attachment of a punch needle for forming a plurality of small holes on a sheet of workpiece by piercing the workpiece in dot-by-dot strokes of the punch needle, a transfer mechanism that transfers the workpiece in two predetermined directions in coordination with an up and down movement of the punch needle to execute a holing operation for forming the small holes on the workpiece. The punch data generating device includes a cut data generator that generates cut data constituting the punch data, the cut data being configured to instruct consecutive formation of the small holes at least along an outline of a pattern section of the workpiece in which a predetermined pattern is drawn to allow cutting of the outline.

8 Claims, 32 Drawing Sheets

| LINE NO. | PUNCH TYPE | LINE ELEMENTS |
|---|---|---|
| 1 | CUT | P0,P1,P2,P3,P4,P5,P6,P7 |
| 2 | DRAW | P0,P7 |
| 3 | CUT | P7,P8,P9,P10,P11,P12 |
| 4 | CUT | P12,P13,P14,P15,P16,P17,P18,P19 |
| 5 | DRAW | P12,P19 |
| 6 | CUT | P19,P0 |
| 7 | DRAW | P20,P21,P22,P23,P24,P25,P20 |
| 8 | DRAW | P26,P27,P28,P29,P30,P31,P26 |
| 9 | DRAW | P32,P33,P34,P32 |
| 10 | DRAW | P35,P36,P37,P38 |

FIG.8

PUNCH DATA GENERATING DEVICE AND COMPUTER READABLE MEDIUM STORING PUNCH DATA GENERATING PROGRAM

CROSS-REFERENCE TO RELATED APPLICATIONS

This application is based upon and claims the benefit of priority from the prior Japanese Patent Application 2009-205823, filed on Sep. 7, 2009, and Japanese Patent Application 2009-205824, filed on Sep. 7, 2009 the entire content of which are incorporated herein by reference.

FIELD

The present disclosure relates to a punch data generating device that generates punch data for execution of a holing operation by an embroiderable sewing machine to form small holes on workpiece sheet. The present disclosure also relates to a computer readable medium storing a punch data generating program.

BACKGROUND

Conventional multi-needle embroidery sewing machines are capable of consecutive executions of embroidery sewing operations with multiple thread colors. A typical multi-needle embroidery sewing machine of such type is provided with a sewing mechanism and a controller that controls the sewing mechanism. The sewing mechanism is configured, for instance, by a needle-bar case containing six needle bars, a needle-bar selection mechanism, and a needle-bar drive mechanism. The needle-bar selection mechanism selects a given needle by transferring the needle-bar case in the left and right direction and the selected needle bar is connected to the needle-bar drive mechanism to be driven up and down. The sewing mechanism is further configured by a transfer mechanism that transfers an embroidery frame holding a workpiece cloth in the X and Y directions. The controller, on the other hand, receives input of pattern data that contains instructions on the amount of stroke-by-stroke movement of workpiece cloth/embroidery frame, and on timing for changing the thread color, etc. Based on the pattern data, the controller transfers the embroidery frame holding the workpiece cloth in the X and Y directions by the transfer mechanism while controlling other components of the sewing mechanism to form embroidery in multiple colors.

Some embroidery sewing machines come with a heat cutter provided with a heater for creating patches of images and characters. Such heat cutters are attached to the carriage of a drive mechanism of an embroidery frame. The heat cutter cuts through fabric and paper to cut out the patches.

The inventors have conceived to utilize the multi-needle embroidery sewing machine as a device for creating patterns on a sheet of workpiece such as paper. One exemplary configuration for creating the patterns with the multi-needle sewing machine may be as follows. Some of the plurality of needle bars may have one or more punch needle(s) for forming small holes instead of a sewing needle (s). Further, embroidery frame for holding the workpiece being attached to the transfer mechanism may be replaced by a holder providing a secure hold of the workpiece which is also attached to the transfer mechanism. Thus, a desired pattern made of a plurality of small holes can be created on the surface of the workpiece cloth by moving the needle bar(s) having punch needle(s) attached to it up and down by the needle bar drive mechanism while transferring the holder holding the workpiece by the transfer mechanism.

After creating the pattern made of multiplicity of small holes on workpiece such as paper with the above configured device, the user may desire to cut out the created pattern along the outline of the workpiece. In such case, it would be quite troublesome for the user to neatly cut out the pattern from the workpiece manually with scissors, etc. Thus, the aforementioned cutter may be attached to the sewing machine to cut out the workpiece in the desired shape. Another alternative may be to use a dedicated cutter known as a cutting plotter.

In either of the above alternative cases, a separate cutter or a cutter plotter need to be prepared as an attachment to the sewing machine, and thus, would lead to cost increase of the system.

SUMMARY

One object of the present disclosure is to provide a punch data generating device that generates punch data for executing a holing operation on a sheet of workpiece with an embroiderable sewing machine and that allows cutting of the workpiece along the outline of a given pattern and to provide a computer readable medium storing a punch data generating program.

According to one aspect of the present disclosure, a punch data generating device is disclosed that generates punch data for execution with an embroiderable sewing machine including a needle bar allowing attachment of a punch needle for forming a plurality of small holes on a sheet of workpiece by piercing the workpiece in dot-by-dot strokes of the punch needle, a transfer mechanism that transfers the workpiece in two predetermined directions in coordination with an up and down movement of the punch needle to execute a holing operation for forming the small holes on the workpiece. The punch data generating device includes a cut data generator that generates cut data constituting the punch data, the cut data being configured to instruct consecutive formation of the small holes at least along an outline of a pattern section of the workpiece in which a predetermined pattern is drawn to allow cutting of the outline.

According to another aspect of the present disclosure, a computer readable medium storing a punch data generating program is disclosed that generates punch data for execution with an embroiderable sewing machine including a needle bar allowing attachment of a punch needle for forming a plurality of small holes on a sheet of workpiece by piercing the workpiece in dot-by-dot strokes of the punch needle, a transfer mechanism that transfers the workpiece in two predetermined directions in coordination with an up and down movement of the punch needle to execute a holing operation for forming the small holes on the workpiece. The punch data generating program stored in the computer readable medium includes instructions for generating cut data constituting the punch data, the cut data being configured to instruct consecutive formation of the small holes at least along an outline of a pattern section of the workpiece in which a predetermined pattern is drawn to allow cutting of the outline.

BRIEF DESCRIPTION OF THE DRAWINGS

Other objects, features and advantages of the present disclosure will become clear upon reviewing the following description of the illustrative aspects with reference to the accompanying drawings, in which.

FIG. 8 exemplifies a data configuration of line data;

DETAILED DESCRIPTION

A description will be given hereinafter on a first exemplary embodiment of the present disclosure with reference to FIGS. 1 to 15. The first exemplary embodiment describes a case where a multi-needle embroidery sewing machine capable of forming embroideries includes the features of a punch data generating device. The multi-needle embroidery sewing machine may also be referred to as embroidery sewing machine or embroiderable sewing machine. First, a description will be given on the configuration of multi-needle embroidery sewing machine 1. In the description given hereinafter, the left and right direction relative to multi-needle embroidery sewing machine 1, is defined as the X direction whereas the front and rear direction relative to multi-needle embroidery sewing machine 1 is defined as the Y direction as indicated in FIGS. 1 to 3.

Figure 1:
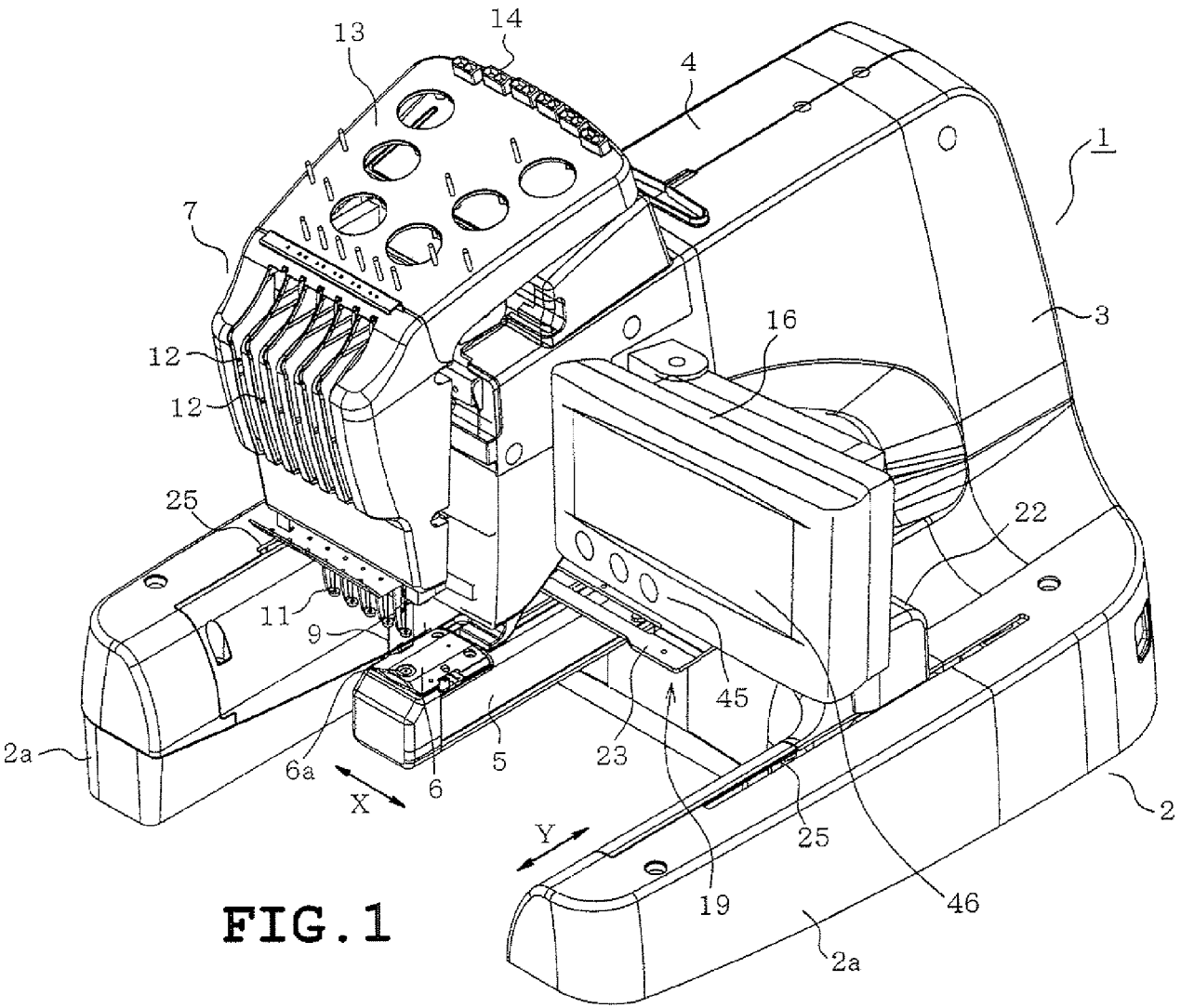
FIG. 1 is a general perspective view of a multi-needle embroidery sewing machine according to a first exemplary embodiment of the present disclosure.

Referring to FIG. 1, multi-needle embroidery sewing machine 1 is primarily configured by support base 2 placed on a placement base not shown, pillar 3 extending upward from the rear end of support base 2, and arm 4 extending forward from the upper end of pillar 3. Support base 2 is configured in U-shape in top view with left and right feet 2*a* extending forward to embrace a forward opening between them. Support base 2 is further provided integrally with cylinder bed 5 extending forward from its rearward mid portion. On the upper portion of the extremity of cylinder bed 5, needle plate 6 is provided that has needle holes 6*a* defined on it. Though not shown, cylinder bed 5 contains components such as a loop taker shuttle, a thread cut mechanism, and a picker.

Figure 6:
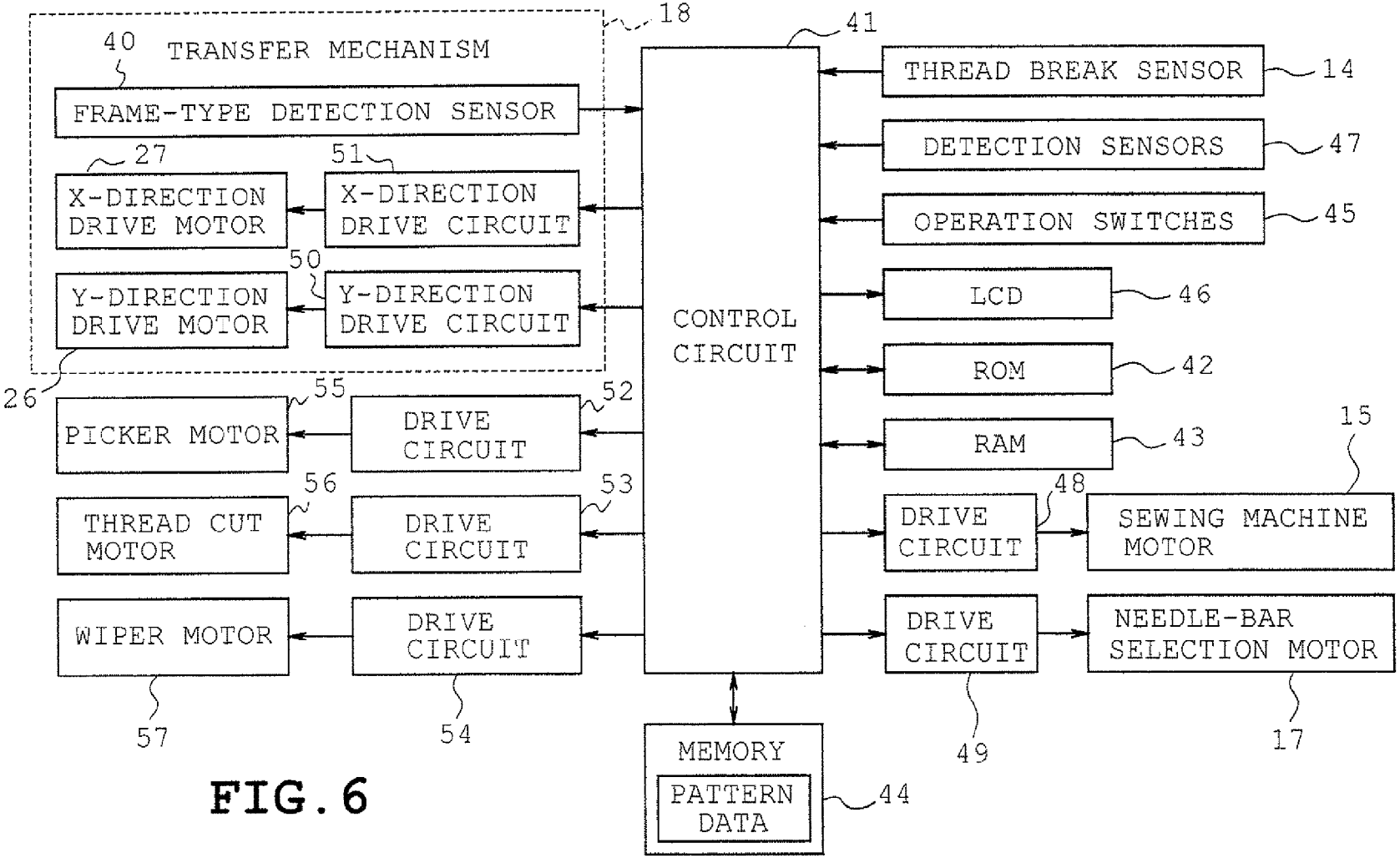
FIG. 6 is an overall block diagram of an electrical configuration of the multi-needle embroidery sewing machine.

On the right side of arm 4, control panel 16 is provided that is implemented with elements such as control switches 45 to allow the user to make various instructions, selections, and inputs and a liquid crystal display 46, simply represented as LCD 46 in FIG. 6, that displays various messages, etc. to be presented to the user. As later described, LCD 46 displays images of patterns and outlines based on punch data. Though not shown, at the rear side upper portion of arm 4, a thread supplier capable of accommodating multiple thread spools is provided, which is configured to hold six thread spools in the present exemplary embodiment.

Figure 2:
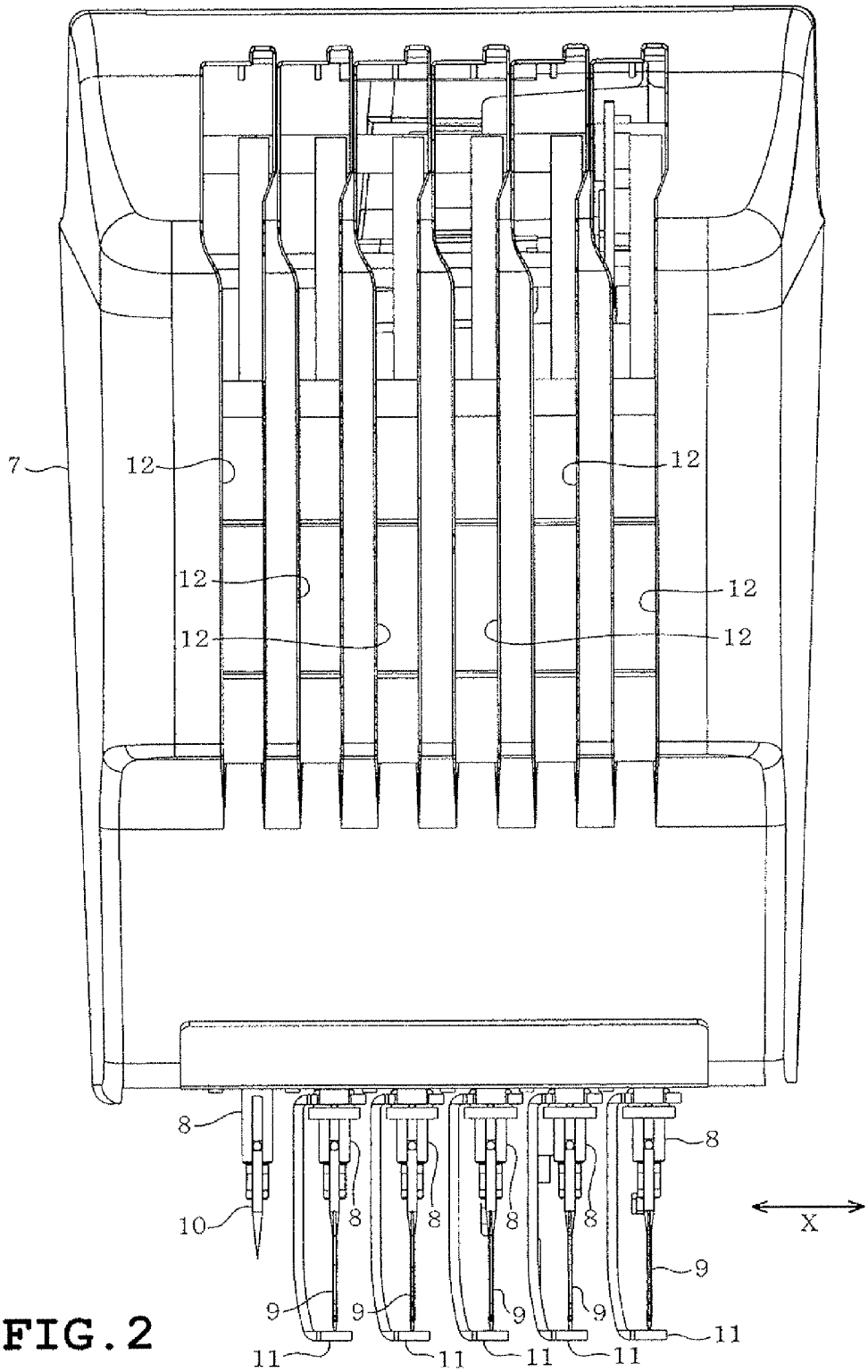
FIG. 2 is a front view of a needle bar case.
Figure 3:
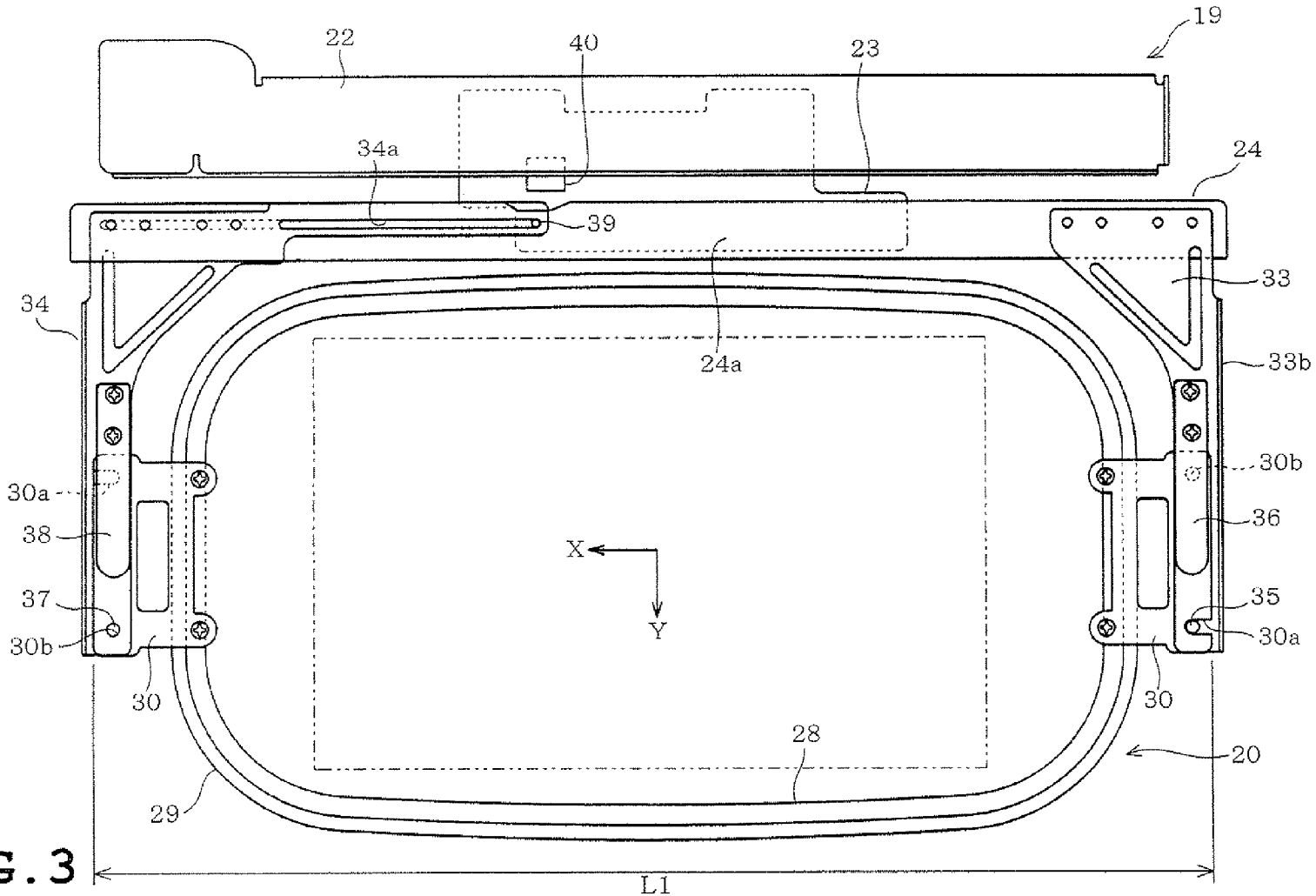
FIG. 3 is a plan view of a frame holder with an embroidery frame attached.

As also shown in FIG. 2, on the extremity of arm 4, needle bar case 7 is provided which is movable in the left and right direction which also referred to as the X-direction. As can be seen in FIG. 2, needle bar case 7 is longitudinally thin, and comes in a shape of a rectangular box. Needle bar case 7 contains a plurality of needle bars 8, six, in the present exemplary embodiment, aligned in the left and right direction so as to be movable up and down. Each needle bar 8 is subject to consistent upward bias toward the uppermost position shown in FIG. 2 by a coil spring not shown.

The lower ends of these needle bars 8 extend downward out of needle case 7 and sewing needle 9 used for embroidery sewing is detachably/interchangeably attached to them. The six needle bars 8 are identified by needle bar numbers 1 to 6, in this case, in ascending order from right to left. In the present exemplary embodiment, the leftmost specific needle bar 8 among the six needle bars 8, that is, the no. 6 needle bar 8, has punch needle 10 detachably attached to it instead of sewing needle 9. Punch needle 10 will be later described in detail.

Referring to FIG. 2, at the lower portion of needle bar 8, presser foot 11 for use in embroidery sewing is provided that is moved up and down in synchronism with needle bar 8. Presser foot 11 for the no. 6 needle bar 8 is removed when punch needle 10 is attached instead of sewing needle 9. Though not shown in detail, above needle bar case 7, six thread take-ups are provided, each dedicated to each of the six needle bars 8. The tip of each thread-take up protrudes forward through six vertical slits 12 defined on the front face of needle bar case 7 and is driven up and down in synchronism with the up and down movement of needle bar 8. Though also not shown, behind needle bar 8 which is placed in a position to be driven up and down by a later described needle-bar vertically moving mechanism, a wiper is provided.

Referring to FIG. 1, needle bar case 7 has upper cover 13 provided integrally with it that extends obliquely reward from its upper end. Though only mounting holes are shown, upper cover 13 is provided with six thread tension regulators along with six thread break sensors 14 provided on its upper end. The needle thread for embroidery sewing is drawn from the thread spools set to the thread supplier and is sequentially engaged with a threading route including components such as thread break sensor 14, thread tension regulators, and thread take-ups. When needle thread is finally passed through eye not shown of sewing needle 9, multi-needle embroidery sewing machine 1 is ready for embroidery sewing. By supplying different colors of needle threads to each of the six or five sewing needles 9, embroidery sewing operation with multiple needle colors can be executed consecutively by automatic switching of thread colors.

Though not shown in detail, pillar 3 is provided with sewing machine motor 15 only shown in FIG. 6. As known in the art, arm 4 is provided with components such as a main shaft driven by sewing machine motor 15, a needle-bar vertically drive mechanism that vertically moves needle bars 8 etc., by the rotation of the main shaft, and a needle-bar selector/driver mechanism that selects needle bar 8 by moving needle bar case 7 in the X-direction. The rotation of the main shaft also causes the loop taker shuttle to be driven in synchronism with the up and down movement of needle bar 8.

Needle-bar vertically moving mechanism is provided with a vertically moving element that is selectively engaged with needle bar clamp not shown provided at needle bar 8. The needle-bar selector/driver mechanism is driven by needle-bar selection motor 17 only shown in FIG. 6 to move needle bar case 7 in the X-direction to select either of needle bars 8, located immediately above needle hole 6*a*, to be engaged with the vertically moving element. Needle-bar selector/driver mechanism configured as described above selects one of the needle bars 8 and the selected needle bar 8 and the thread take-up corresponding to the selected needled bar 8 is moved up and down by the needle-bar vertically moving mechanism.

Then as shown in FIG. 1, in the front side of pillar 3 above support base 2, carriage 19 of transfer mechanism 18 shown in FIG. 6 is provided slightly above cylinder bed 5. Carriage 19 allows detachable attachment of embroidery frame 20 shown in FIG. 3 for holding a workpiece cloth to be embroidered or holder 21 shown in FIGS. 4, 5A, and 5B for holding a sheet of workpiece W made of paper and plastic etc., on which a later described holing operation is performed. In the present exemplary embodiment, embroidery frame 20 for holding the workpiece cloth and coming various shapes and sizes are provided as accessories to multi-needle embroidery sewing machine 1.

As shown in FIGS. 1 and 3, carriage 19 is provided with Y-direction carriage 22, X-direction carriage 23 provided at Y-direction carriage 22, and frame holder 24 only shown in FIG. 3 attached to X-direction carriage 23. Though not shown in detail, transfer mechanism 18 includes a Y-direction drive mechanism provided within support base 2. Y-direction drive mechanism moves Y-direction carriage 22 freely in the Y direction, that is, the front and rear direction. Transfer mechanism 18 also includes an X-direction drive mechanism provided within Y-direction carriage 22. The X-direction drive mechanism transfers X-direction carriage 23 and frame holder 24 in the X direction, that is, the left and right direction. Embroidery frame 20 or holder 21 is held by frame holder 24 and is moved freely in the two predetermined directions, in this case, the X and Y directions by transfer mechanism 18.

To elaborate, Y-direction carriage 22 comes in a shape of an elongate, narrow box which extends in the X direction or the left and right direction over feet 2*a* of support base 2. As can be seen in FIG. 1, on the upper surface of left and right feet 2*a* of support base 2, guide groove 25 is defined that runs in the Y direction or the front and rear direction. Though not shown, the Y-direction mechanism is provided with a couple of transfer elements that vertically penetrates these guide grooves 25 to allow Y direction or front and rear movement along guide grooves 25. Both left and right ends of Y-direction carriage 22 is connected to the upper end of the couple of transfer elements respectively.

The Y-direction drive mechanism is configured by Y-direction drive motor 26 shown in FIG. 6 comprising a step motor, and a linear transfer mechanism including components such as a timing pulley and timing belt, etc. The linear transfer mechanism driven by Y-direction drive motor 26 moves the transfer elements to allow Y-direction carriage 22 to be moved in the Y direction or the front and rear direction.

Referring to FIGS. 1 and 3, a portion of X-direction carriage 23 protrudes forward from the lower front side of Y-direction carriage 22. X-direction carriage 23 comes in the form of a laterally wide plate and is supported slidably in the X-direction or the left and right direction by Y-direction carriage 22. The X-direction drive mechanism provided within Y-direction carriage 22 is configured by X-direction drive motor 27 shown in FIG. 6 comprising a step motor, and a linear transfer mechanism including a timing pulley and timing belt, etc. X-direction carriage 23 is moved in the X direction or the left and right direction by the above described configuration.

Next, a description will be given on frame holder 24 attached to X-direction carriage 23, and embroidery frame 20 and holder 21 serving as a holder being detachably attached to frame holder 24. First, a description will be given on embroidery frame 20 with reference to FIG. 3. Embroidery frame 20 comprises inner frame 28 generally formed as a rectangular frame with rounded corners, outer frame 29 fitted detachably on the outer periphery of inner frame 28, and a pair of connecting portions 30 mounted on both left and right ends of inner frame 28. Though not shown, the workpiece cloth is clamped between inner frame 28 and outer frame 29 to hold the workpiece cloth in a tense, stretched state within inner frame 28.

The left and right pair of connecting portions 30 is provided on embroidery frame 20 so as to have 180-degrees rotational symmetry in plan view. Connecting portions 30 have engagement grooves 30*a* and engagement holes 30*b* for attachment to frame holder 24. Though not shown, different types of embroidery frame 20 are provided that come in different shapes and sizes having varying embroidery areas and are selected interchangeably depending on the size of the workpiece cloth and the embroidery. The width in the left and right direction, that is, the measurement between the outer edges of the connecting portions 30 represented as L1 in FIG. 3, is configured to vary depending upon the type of embroidery frame 20. The variance in width L1 allows the later described detector to detect the type of embroidery frame 20 and whether or not holder 21 has been attached instead of embroidery frame 20. FIG. 3 shows embroidery frame 20 having the greatest width L1.

Figures 5A, 5B:
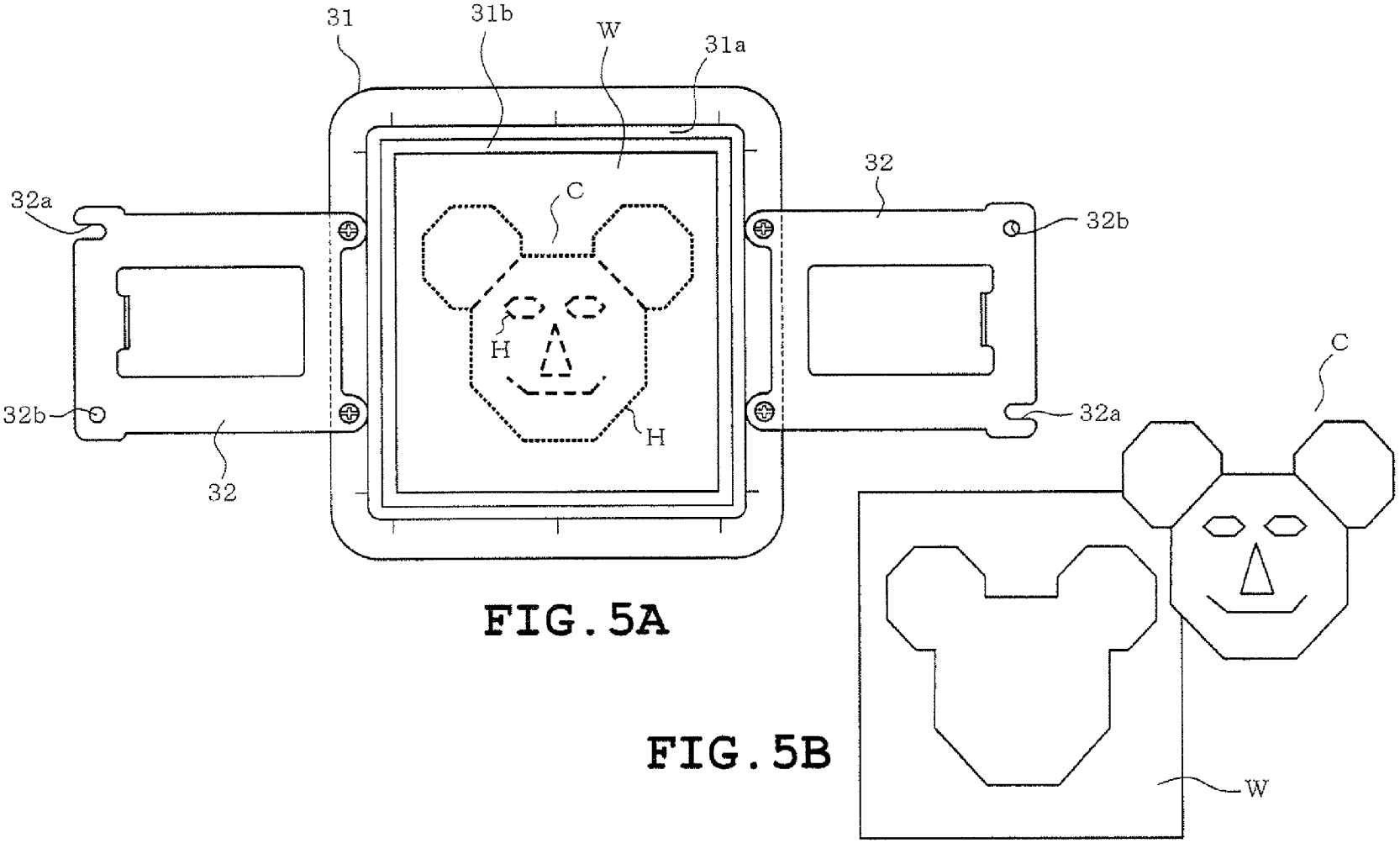
FIG. 5A is a plan view of a workpiece with small holes formed on it.
FIG. 5B is a plan view showing the outline cut out from the workpiece.

Next, a description will be given on holder 21. As shown in FIGS. 5A and 5B, holder 21 is provided with holder section 31 shaped as a rectangular plate with rounded corners and a pair of connecting portions 32 mounted on left and right ends of holder section 31. On the face of holder section 31, an enclosed bottom holder recess 31*a* is defined in a rectangular shape which contains elastic element 31*b*. Elastic element 31*b* is formed as a thin rectangular plate made of material such as foam resin or foam rubber. A sheet of workpiece W prepared in a rectangular shape corresponding to holder recess 31*a* is placed on the upper surface of elastic element 31*b* and is secured by fastening elements not shown such as a double-stick tape.

Figure 4A:
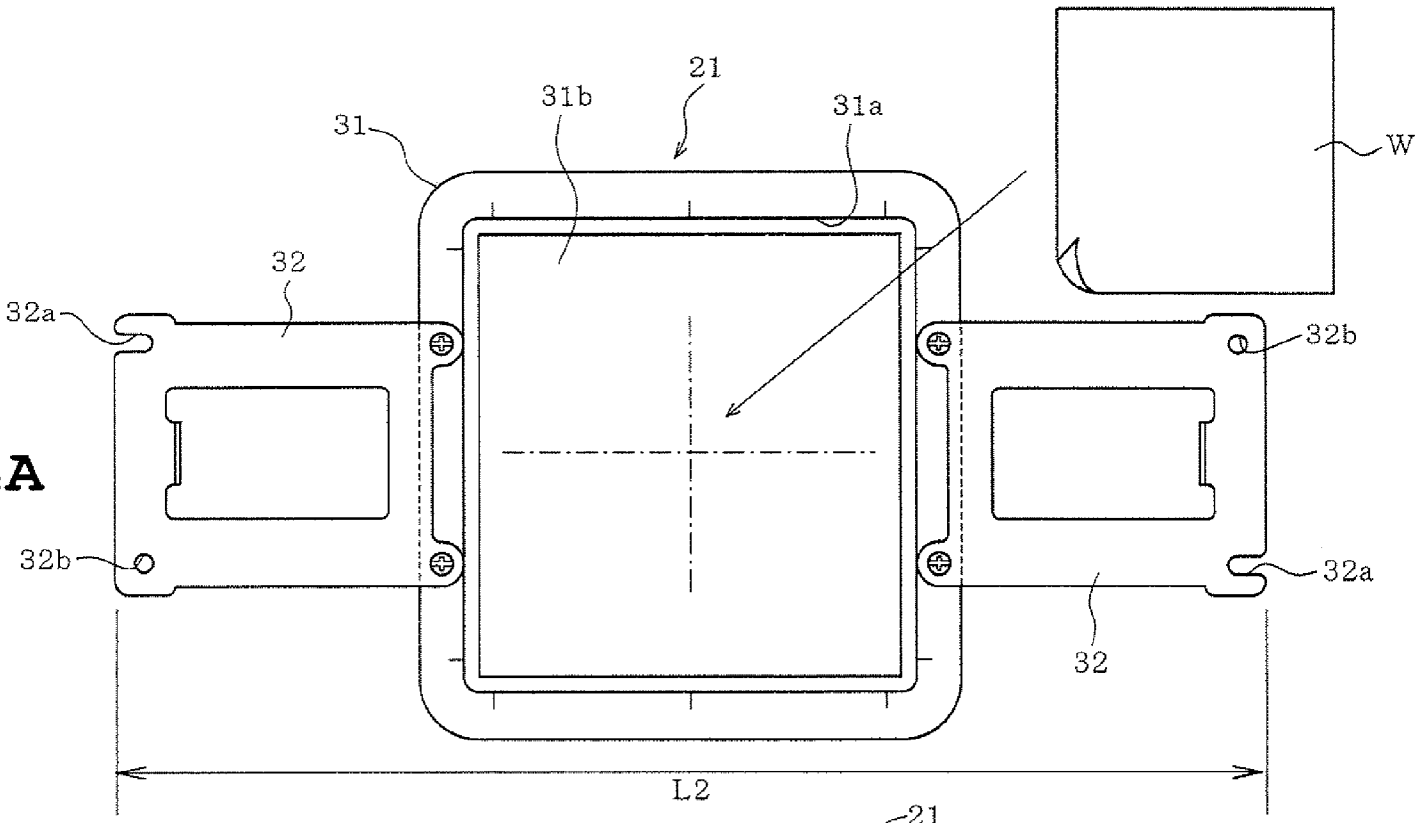
FIG. 4A is a plan view of a holder.
Figure 4B:
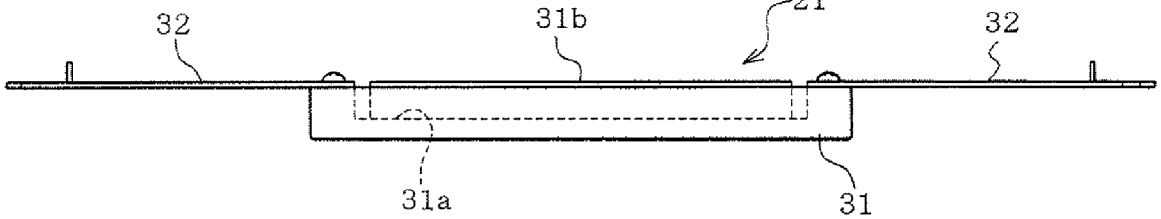
FIG. 4B is a front view of the holder.

The left and right pair of connecting portions 32 is also disposed in 180-degrees rotational symmetry in plan view. Connecting portions 32 have engagement grooves 32*a* and engagement holes 32*b* for attachment to frame holder 24. The width in the left and right direction of holder 21, that is, the measurement between the outer edges of the connecting portions 32 represented as L2 in FIG. 4A, is configured to vary from width L1 of any given type of embroidery frame 20. Different types of holder 21 may also be provided depending on the shapes and sizes etc., of workpiece W as was the case of embroidery frame 20.

Frame holder 24 to which the above described embroidery frame 20 and holder 21 are attached/connected is configured as described below. Referring to FIG. 3, frame holder 24 is mounted unremovably on the upper surface of X-direction carriage 23. Frame holder 24 is provided with a stationary arm 33 and movable arm 34 mounted relocatably on stationary arm 33. Movable arm 34 is relocated in the left and right direction by the user depending upon the type, that is, width L1 or L2 of embroidery frame 20 or holder 21, whichever is attached.

Stationary arm 33 is placed over the right side upper surface of main section 24 of frame holder 24. Frame holder 24 is formed as an X-directionally elongate plate. Stationary arm 33 is provided with right arm 33*b* that is bent in a substantially right angle to extend forward. Provided on the upper surface extremity of right arm 33*b* are engagement pin 35 and leaf spring 36 for clamping connecting portions 30 and 32 provided rearward relative to engagement pin 35. Engagement pin 35 engages with engagement groove 30*a* of connecting portion 30 of embroidery frame 20 or engagement groove 32*a* of connecting portion 32 of holder 21.

Movable arm 34 is symmetrical in the left and right direction with right arm 33*b*. The base end or the rear end of movable arm 34 is mounted on main section 24*a* of frame holder 24 so as to be placed over the left side upper surface of main section 24*a*. Provided on the upper surface extremity of movable arm 34 are engagement pin 37 and leaf spring 38 for clamping connecting portions 30 and 32 provided rearward relative to engagement pin 37. Engagement pin 37 engages with engagement hole 30*b* of connecting portion 30 of embroidery frame 20 or engagement hole 32*b* of connecting portion 32 of holder 21.

On the base end or the rear end of movable arm 34, guide groove 34*a* is provided that extends in the left and right direction. Guide groove 34*a* allows engagement of guide pin 39 provided on the upper surface of main section 24*a* of frame holder 24. Thus, movable arm 34 is allowed to slide in the left and right direction relative to main section 24*a* of frame holder 24. Though not shown, main section 33*a* of stationary arm 33 is provided with a lock mechanism that allows movable arm 34 to be selectively locked at different predetermined positions. The position of movable arm 34 is relocated in the left and right direction through user operation of the lock mechanism.

The above described configuration allows the user to lock movable arm 34 at a position suitable for the type, in other words, the width such as L1 and L2 of embroidery frame 20 or holder 21 to be attached and proceed to attachment of embroidery frame 20 or holder 21 to frame holder 24. As exemplified in FIG. 3, in attaching embroidery frame 20 to frame holder 24, first, connecting portions 30 at the left and right ends of embroidery frame 20 are each inserted in the rearward direction from the front side of leaf spring 38 of movable arm 34 and leaf spring 36 of right arm 33*b*, respectively. Then, engagement pin 37 of movable arm 34 is engaged with engagement hole 30*b* of connecting portion 30 and engagement pin 35 of right arm 33*b* is engaged with engagement groove 30*a* of connecting portion 30. Thus, embroidery frame 20 is held by frame holder 24 and transferred in the X and Y directions by transfer mechanism 18. Holder 21 is attached to frame holder 24 in the same manner.

As shown in FIGS. 3 and 6, X-direction carriage 23 is provided with frame-type sensor 40 for detecting the type of embroidery frame 20 or holder 21 attached through detection of the position of movable arm 34. Though not shown, frame-type sensor 40 comprises a rotary potentiometer, for example, and is provided with a detection tip that is placed in contact with detection subject comprising a sloped surface, for example, provided on movable arm 34. The relocation of movable arm 34 in the left and right direction alters the height of the sloped surface placed in contact with the detection tip. This causes change in the rotational angle of the detection tip to cause variation in the output signals of frame-type detection sensor 40. As shown in FIG. 6, the output signal of frame-type detection sensor 40 is inputted to a later described control circuit 41 whereafter the type of embroidery frame 20 or holder 21 is determined by control circuit 41 based on the difference of the incoming output signal from frame-type detection sensor 40.

In the present exemplary embodiment, multi-needle embroidery sewing machine 1 is capable of executing a normal embroidery sewing operation on the workpiece cloth using six colors of embroidery thread as well as executing a holing operation on workpiece W. Holing operation is executed by impinging, in this case, piercing punch needle 10 dot by dot on the surface of workpiece W while transferring holder 21 in the X and Y directions by transfer mechanism 18 to form a plurality of small holes H on workpiece W as shown in FIG. 7. By holing workpiece W, various patterns can be created on workpiece W. Apart from such pattern formation, holing process may be utilized, for instance, to cut workpiece W into a predetermined shape by forming small holes H consecutively along the outline of the created pattern.

In executing a holing operation, sewing needle 9 provided on the leftmost, that is, the no needle bar 8 of the six needle bars 8 is replaced by punch needle 10 as shown in FIG. 2. Punch needle 10 has a sharpened tip suitable for forming small holes H on workpiece W and is shorter in length as compared to sewing needle 9. The length of punch needle 10 is so dimensioned such that, when needle bar 8 is lowered to the lowermost position, the tip of punch needle 10 pierces through workpiece W held by holder 21 at the lowermost point of reciprocation of needle bar 8 but stops short of penetrating through elastic element 31*b* provided at holder 21.

As can be seen in FIG. 7, diameter ϕB of a single small hole H formed by the holing operation of punch needle is specified, for instance, at 0.1 mm. Further, as shown in FIG. 2, presser foot 11 is removed from needle bar 8 having punch needle 10 attached to it. As one may readily assume, in case punch needle 10 is attached to the no needle bar 8, embroidery sewing operation is executed with the remaining five needle bars 8 no. 1 to 5 using embroidery threads of five colors or less.

FIG. 6 schematically indicates the electrical configuration of multi-needle embroidery sewing machine according to the present exemplary embodiment with a primary focus on control circuit 41. Control circuit 41 is primarily configured by a computer, in other words, a CPU establishing connection with ROM 42, RAM 43, and external memory 44. ROM 42 stores items such as embroidery sewing control program, holing control program, punch data generating program, and various types of control data. External memory 44 stores items such as various types of embroidery pattern data and punch data.

Control circuit 41 receives input of operation signals produced from various operation switches 45 of the operation panel and is also responsible for controlling the display of LCD 46. The user, while viewing LCD 46, operates various operation switches 45 to select the sewing mode such as the embroidery sewing mode, holing mode, and punch data generating mode and to select the desired embroidery pattern and draw pattern which is formed by holing.

Control circuit 41 also receives input of detection signals such as detection signals from thread break sensor 14, frame-type detection sensor 40 provided at transfer mechanism 18, and other detection sensors 47 including main shaft rotational angle sensor for detecting the rational phase of the main shaft and consequently the elevation of needle bar 8. Control circuit 41 controls the drive of sewing machine motor 15 through drive circuit 48 and needle-bar selection motor 17 through drive circuit 49.

Control circuit 41 further controls the drive of Y-direction drive motor 26 for transfer mechanism 18 through drive circuit 50, and X-direction drive motor 27 through drive circuit 51 to drive frame holder 24 and consequently embroidery frame 20 and holder 21. Further, control circuit 41 executes thread cut operation by controlling picker motor 55 serving as a drive source for a picker not shown, thread cut motor 56 serving as a drive source for a thread cut mechanism not shown, and wiper motor 57 serving as drive source for a wiper not shown through drive circuits 52, 53, and 54, respectively.

Control circuit 41 executes the embroidery sewing control program which automatically executes the embroidery sewing operation on the workpiece cloth held by embroidery frame 20 under the embroidery sewing mode. When executing the embroidery sewing operation, the user is to select pattern data from a collection of embroidery pattern data stored in external memory 44. Embroidery sewing operation is executed by controlling components such as sewing machine motor 15, needle-bar selection motor 17, Y-direction drive motor 26 and X-direction drive motor 27 of transfer mechanism 18 based on the selected pattern data.

As well known, embroidery pattern data contains stroke-by-stroke needle drop point, that is, stroke-by-stroke data or transfer data indicating the amount of X direction or Y direction movement of embroidery frame 20. Further, pattern data contains data such as color change data that instructs switching of embroidery thread color, that is, switching of needle bar 8 to be driven; thread cut data that instructs the thread cut operation; and sew end data.

In the present exemplary embodiment, control circuit 41 automatically executes holing operation on the surface of workpiece W held by holder 21 with punch needle 10 through software configuration, that is, the execution of holing operation control program under the holing operation mode. In the holing operation, control circuit 41 controls sewing machine motor 15, needle-bar selection motor 17, and Y direction motor 26 and X direction motor 27 of transfer mechanism 18 based on the punch data.

Holing operation is executed by selecting the no. 6 needle bar 8 and repeatedly moving the selected needle bar 8, that is, punch needle 10 up and down while moving punch workpiece W to the next holing position when needle bar 8 is elevated. Punch data is primarily configured by a collection of stroke-by-stroke holing position or the punching point of punch needle 10, in other words, stroke-by-stroke movement amount in the X and Y directions of holder 21, that is, punch workpiece W.

In the present exemplary embodiment, as later described through the flowchart, control circuit 41 executes holing operation provided that attachment of holder 21 to frame holder 24 has been detected. This means that the activation of sewing machine motor 15 is not permitted even if execution of holing operation is instructed by the user when attachment of holder 21 has not been detected or when attachment of embroidery frame 20 has been detected.

Further, in the present exemplary embodiment, as will also be later described through the flowcharts, control circuit 41 implements the feature of the punch data generating device, which generates punch data for execution of holing operation through execution of punch data generating program. The punch data contains two types of data, namely, draw data for drawing one or more predetermined pattern(s) on workpiece W through formation of a plurality of small holes H; and cut data for cutting along the outline of the one or more predetermined pattern(s) created on the workpiece W by forming consecutive small holes H along the outline. The punch data generating program may be provided in the form of a computer readable medium such as an optical disc and magnetic disc.

The punch data is generated by extracting the line data, that is, images of lines constituting the image data of a given pattern pre-stored in external memory 44 and specifying a plurality of holing positions or punch dots along each of the extracted lines. In the present exemplary embodiment, control circuit 41 is configured to form small hole H at different pitches depending on whether the punch data specified is the draw data or the cut data when generating the punch data through execution of the punch data generating program. To elaborate, the location of the punch dots are specified so that small hole H is formed at a smaller pitch when formed based on the cut data as compared to when formed based on the draw data.

Figure 7A:
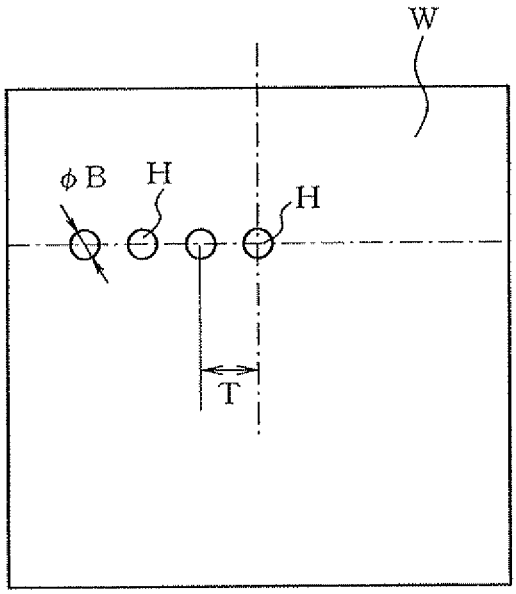
FIG. 7A is a plan view of the workpiece with small holes formed at a pitch being relatively greater in width.
Figure 7B:
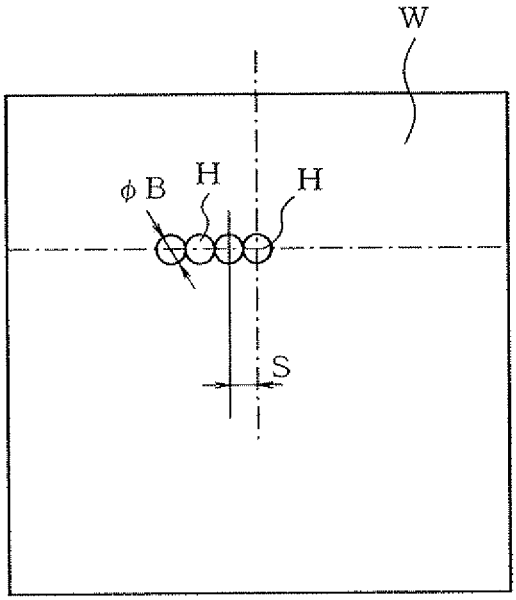
FIG. 7B is a plan view of the workpiece with holes formed at a pitch being relatively less in width.

For example, when generating the draw data (punch data type=draw data), hole-by-hole pitch T or simply pitch T at which the punch dots are specified on the extracted line is set at a value greater than diameter cpB of small hole H such as 0.2 mm as shown in FIG. 7A. When generating the cut data (punch data type=cut data), pitch T at which the punch dots are specified on the extracted line is set at a value equal to or less than diameter ϕB of small hole H such as 0.1 min as shown in FIG. 7B.

As described above, control circuit 41 includes the features for both draw data generation and cut data generation, and thus, the user is given an option to select whether to generate each of the extracted lines as the draw data or the cut data. Alternatively, control circuit 41 may be configured to automatically specify to generate the cut data when the extracted line constitutes an outline and otherwise generate the draw data.

Further, control circuit 41 is configured so that, when generating or editing the punch data as described above, the image of holes H being formed on workpiece W is shown on an edit screen presented on LCD 46. At this instance, control circuit 41 employs different representations for pattern images based on the draw data and for outline images based on the cut data. To elaborate, in the present exemplary embodiment, the pattern images based on the draw data are represented as a collection of broken lines having a length of certain extent, whereas the outline images based on the cut data are represented as a collection of small dots as exemplified in FIG. 10.

Next, the operation of the above described configuration will be described with reference to FIGS. 8 to 15. As typically shown in FIG. 9, a description will be given through an example of generating the punch data for character C showing a face of a mouse with big ears. An example of the draw data will be discussed through drawing of patterns within the bounds or the outline of character C on workpiece W, such as drawing the parts of the face such as the eyes, nose, mouth and the boundaries between the face and the ears. An example of the cut data will be discussed through cutting of outlines of the patterns.

Figure 9:
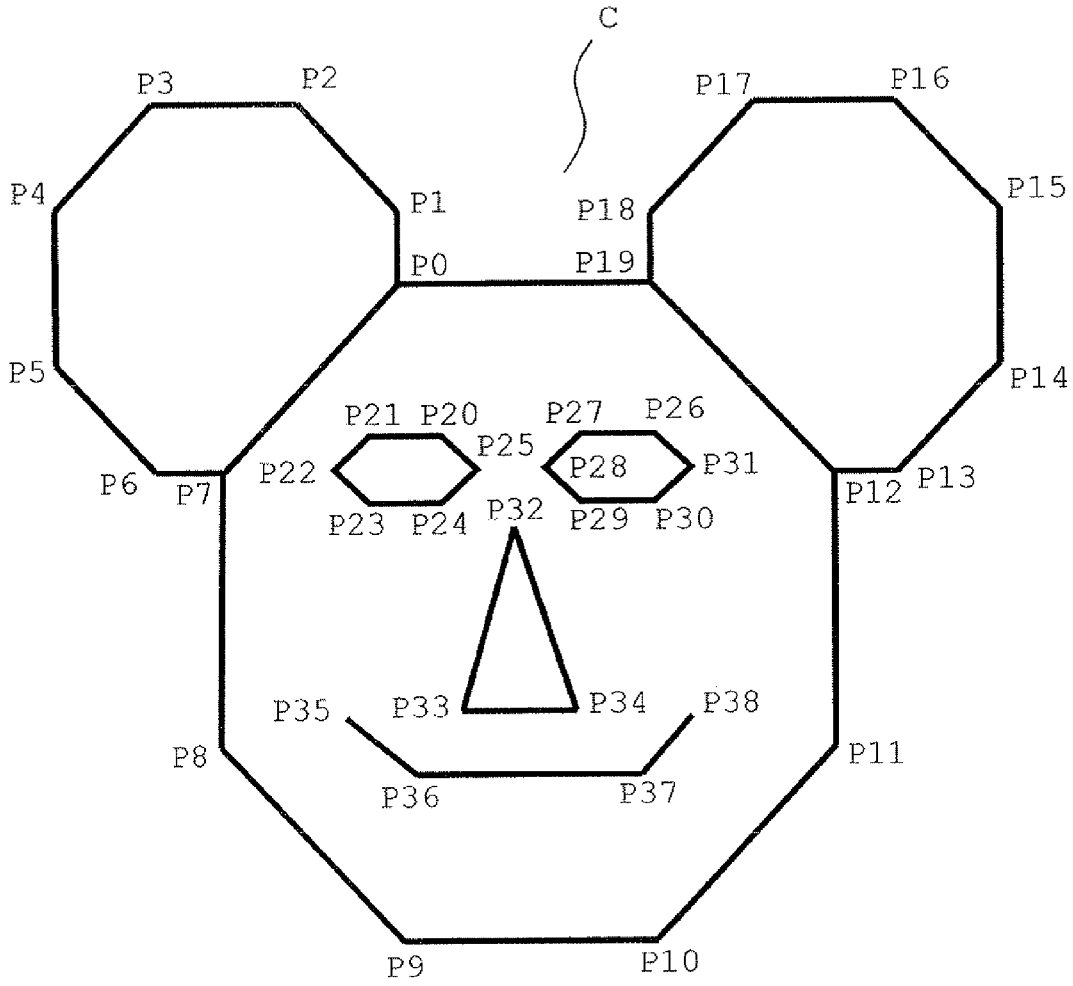
FIG. 9 exemplifies a character being the subject of punch data generation.

FIGS. 8 and 9 indicate the configuration of line data for character C. The line data contains parameters such as the line number of each line; the punch type of each line, that is, whether it constitutes the cut data or the draw data; and collection of position coordinates representing the line elements of each extracted line. The line elements are dots coming at the two ends of a segment within a chain of segments obtained by approximating the extracted line.

For instance, referring to FIG. 9, the line segments shaping the left ear of character C, that is, the line segments that provide the outline of the left ear portion of the entire outline hold a line parameter of: line number=1; punch type=cut; and line elements=P0, P1, P2, P3, P4, P5, P6, and P7. To give another example, the line segment constituting the boundary between the left ear and the face of character C hold a line parameter of: line number=2; punch type=draw; and line elements=P0 and P7. When executing the holing operation, pattern drawing based on the draw data is prior in sequence to outline cutting based on the cut data. In both the draw data and the cut data, the lines are processed in the ascending order of their line numbers.

As described above, control circuit 41, when in the punch data generating mode, extracts the lines, that is, the images of lines constituting the pattern from image data of patterns stored in external memory 44 or ROM 42, based on, for instance, user selection. Then, based on the line data, the punch data generation process is executed to specify a plurality of holing positions or punch dots along the extracted lines. The flowcharts shown in FIGS. 12 to 15 indicate the process flow of punch data generation process executed by control circuit 41.

Figure 12:
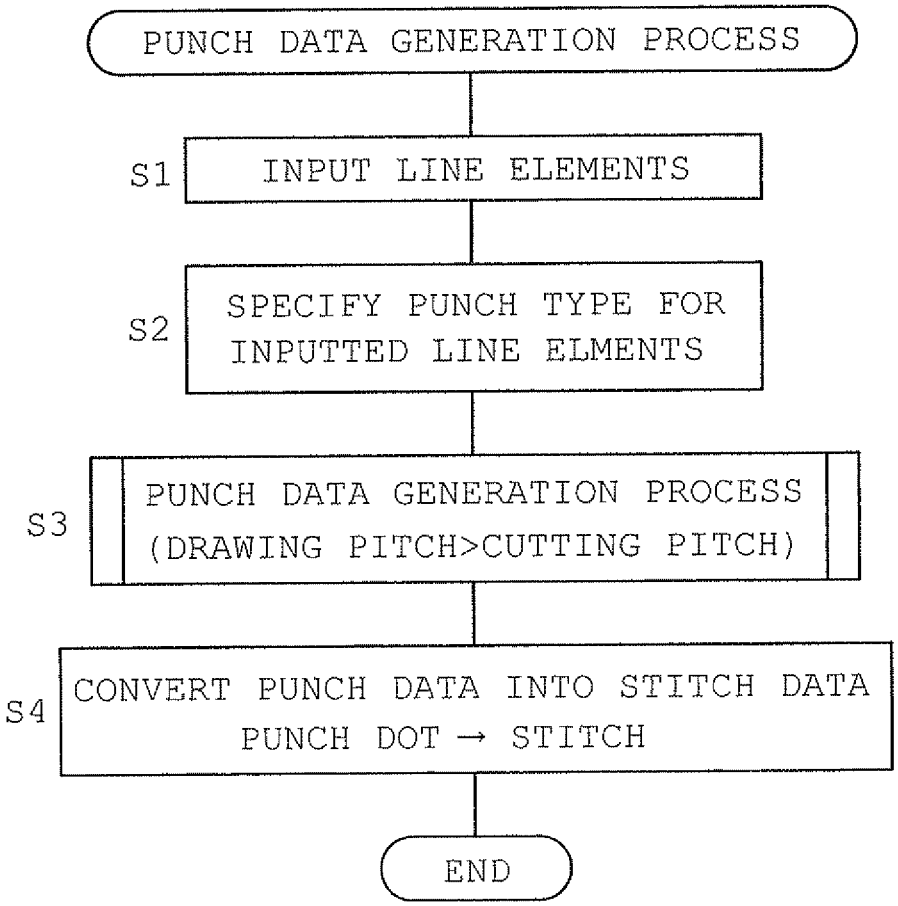
FIG. 12 is a flowchart showing the process flow of the main routine of a punch data generation process executed by a control circuit.
Figure 13:
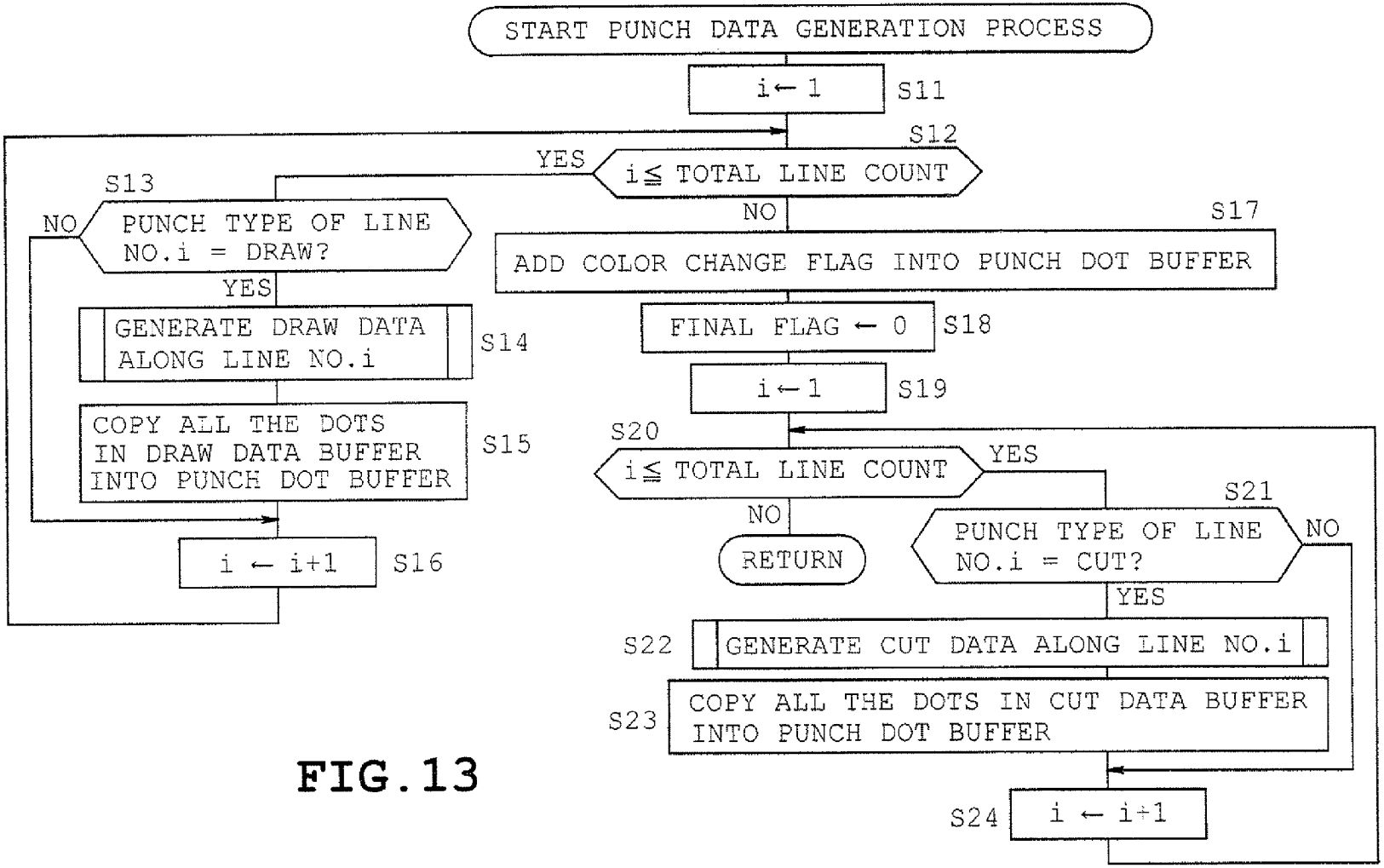
FIG. 13 is a flowchart detailing step S3 of the flowchart of FIG. 12.
Figure 14:
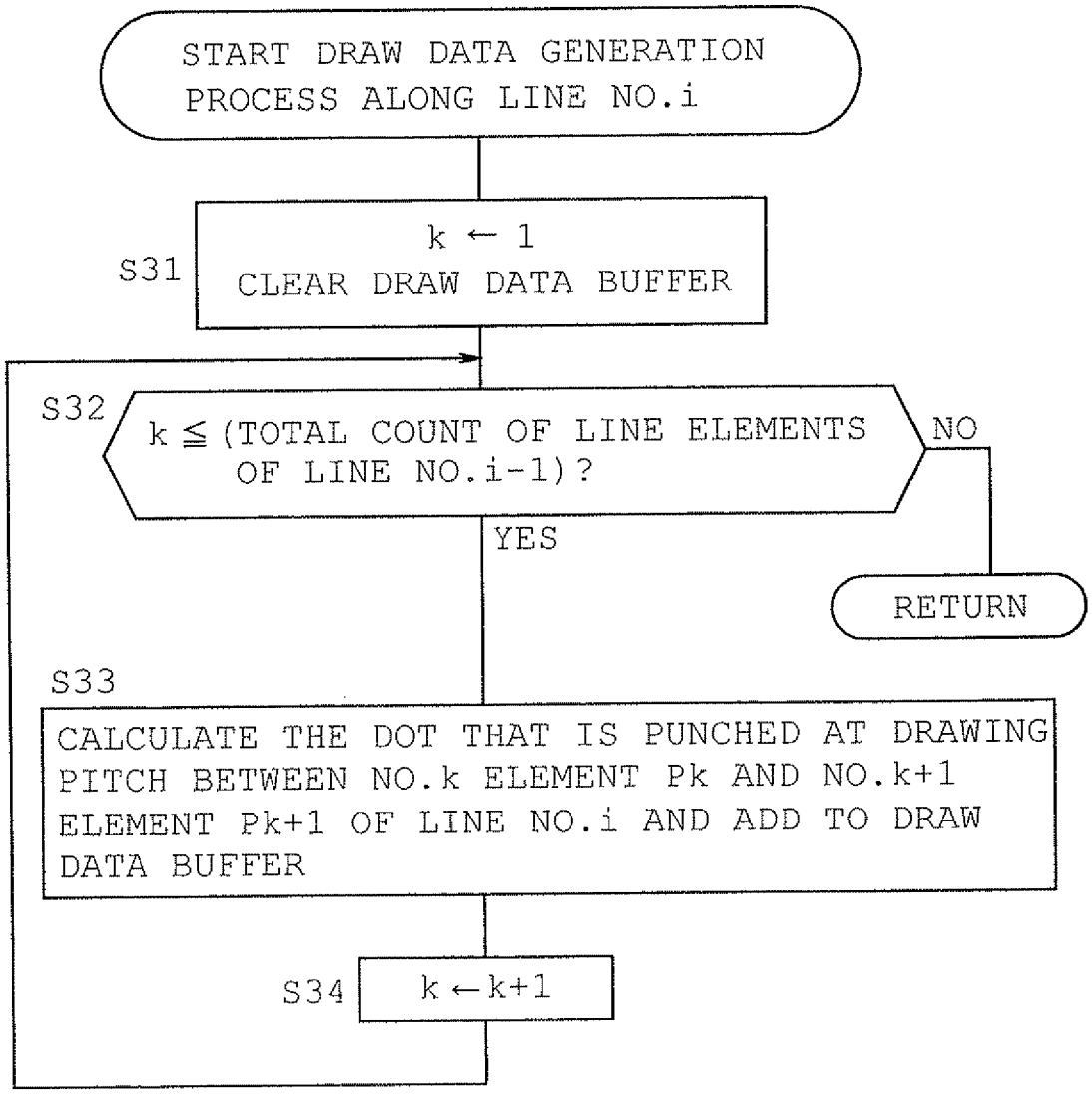
FIG. 14 is a flowchart detailing step S14 of the flowchart of FIG. 13.
Figure 15:
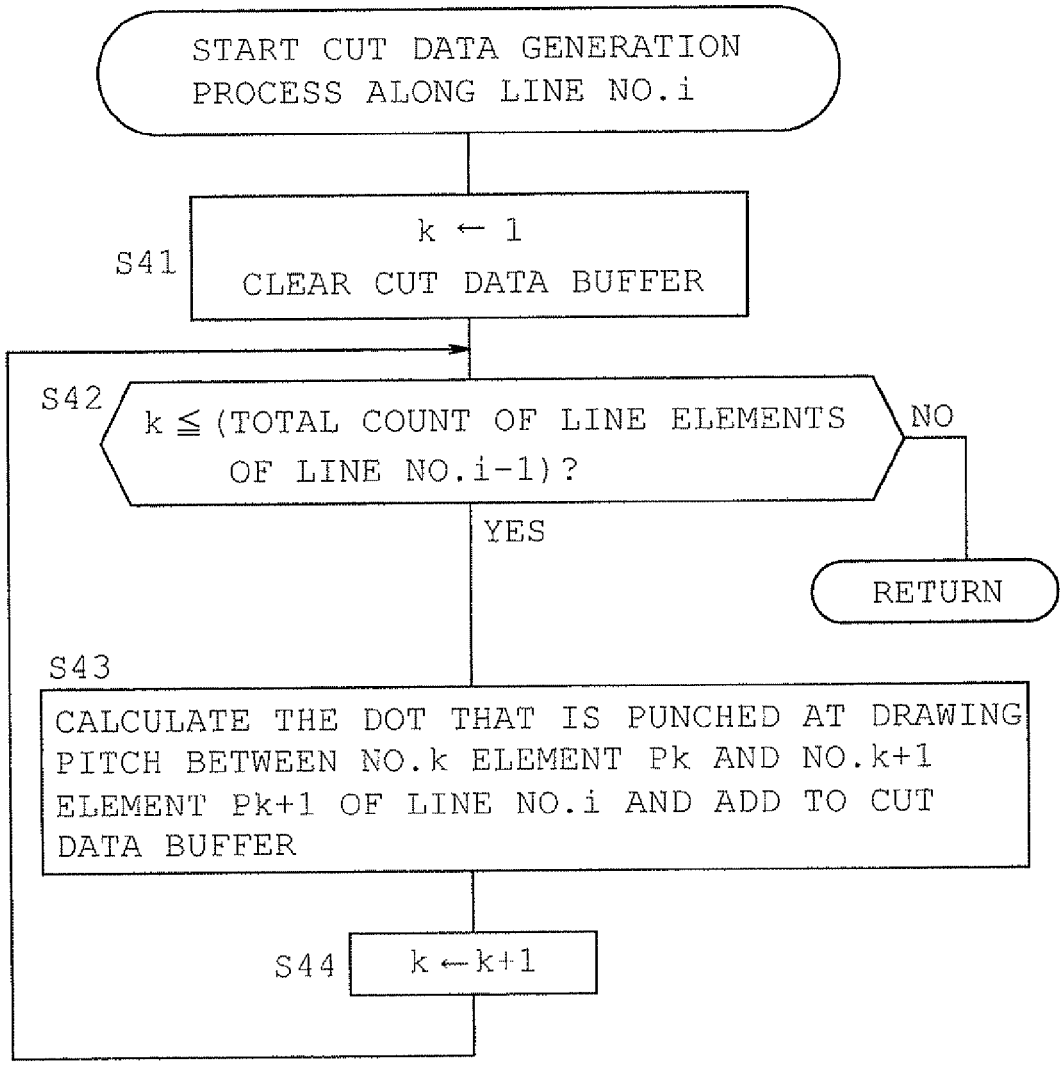
FIG. 15 is a flowchart detailing step S22 of the flowchart of FIG. 13.
Figure 16:
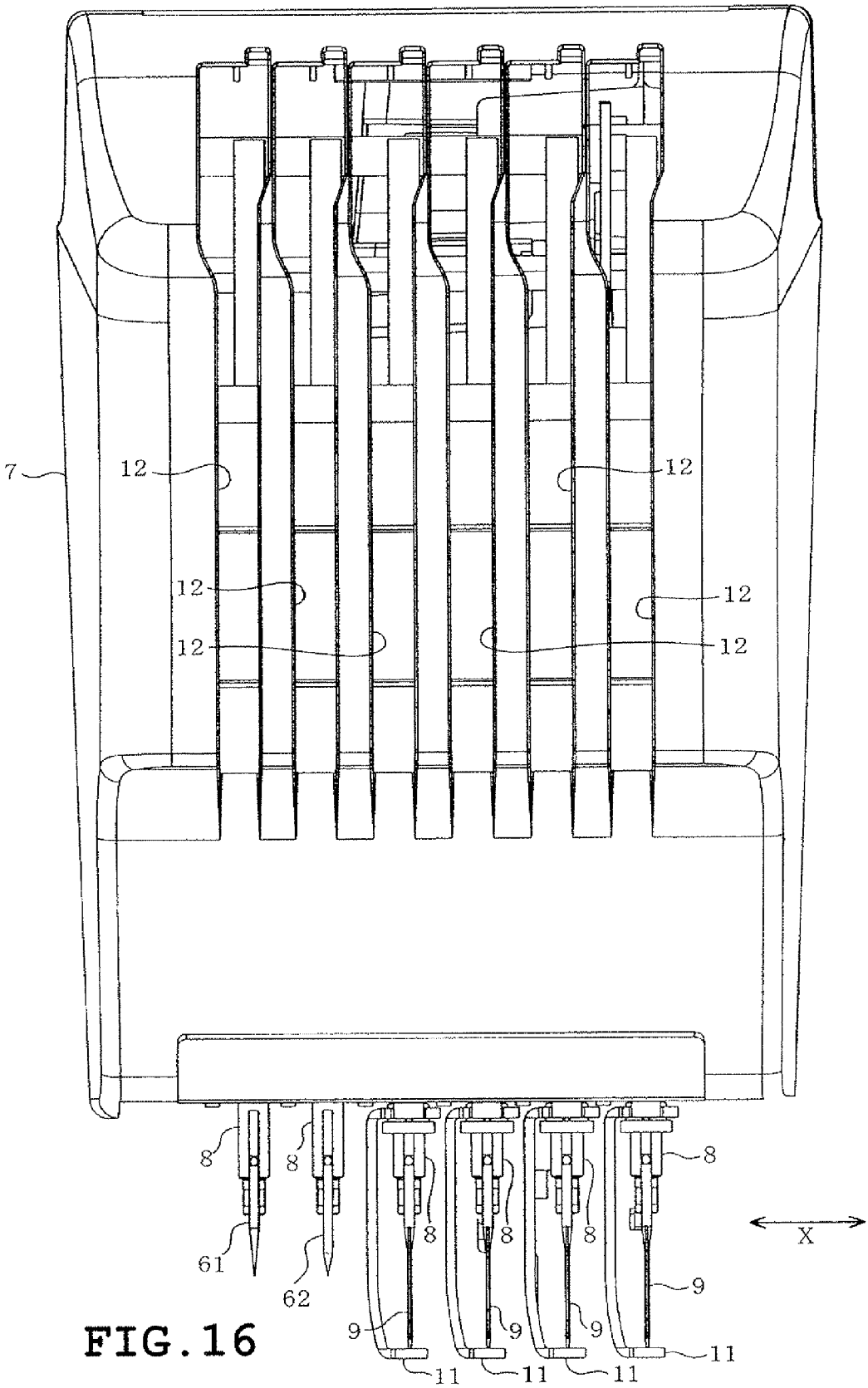
FIG. 16 corresponds to FIG. 2 and illustrates a second exemplary embodiment of the present disclosure.

Among them, flowchart of FIG. 12 indicates the main routine. The flowchart of FIG. 13 shows the details of the punch data generation process identified as step S3 in FIG. 12. The flowchart indicated in FIG. 14 shows the details of the draw data generation process identified as step S14 in FIG. 13. The flowchart of FIG. 15 shows the details of the cut data generation process identified as step S22 in FIG. 13.

That is, as shown in FIG. 12, at step S1, line elements of the lines constituting the pattern are inputted to obtain the line data. This step is executed by displaying the image of character C on LCD 46 and allowing the user to specify the line elements through the screen. Alternatively, control circuit 41 may be configured to automatically extract the lines and their line elements. Step S1 is followed by step S2 in which the type of punch data is specified for each line, in this case, for line numbers 1 to 10. This task may also be automated. Line data as such indicated in FIG. 8 is obtained from steps S1 and S2.

Then, at step S3, the punch data is generated based on the line data. The punch data generation will be later described in detail when discussing flowchart of FIG. 13. If the type of punch data is the cut data, the punch dots are positioned so that small hole H is formed at a smaller pitch as compared to when the type of the punch data is the draw data. As exemplified earlier, the cut data, in this case, may have a 0.1 mm pitch whereas the draw data may have a 0.2 mm pitch. At step S4, the pitch data generated at step S3 which is a collection of position coordinates of the punch dots is converted into stitch data to complete the punch data generation process. Stitch data, in this case, is transfer data representing stroke-by-stroke X-directional and Y-directional movement of holder 21 and consequently workpiece W held by holder 21.

Referring now to the flowcharts of FIGS. 13 and 15, the punch data generation process will be described in detail. The flowchart indicated in FIG. 13 begins with step S11 in which 1 is assigned to variable i that indicates the line number. Then, step S12 determines whether variable i is equal to or less than the total count of lines. In the example shown in FIGS. 8 and 9, the total count of lines amounts to 10. If variable i is equal to or less than the total count of lines (step S12: Yes), the process proceeds to step S13 which determines whether or not the $i^{th}$ line, or line number i is a draw type punch data. If determined to be a cut type punch data (step S13: No), the process proceeds to step S16 which increments variable i by 1 and returns the process flow back to step S12. If determined to be a draw type punch data (step S13: Yes), the process proceeds to step S14 and the draw data is generated for forming holes H along line no. i.

The draw data generation process executed at step S14 is broken down into sub steps in flowchart of FIG. 14. The flowchart begins with step S31 which assigns 1 to variable k that indicates the numbering for identifying a line element provided in a given line number i and clears the draw data buffer. Step S32 determines whether or not variable k is equal to or less than ("total count of line elements"−1). For instance, in line no. 2 of the examples shown in FIGS. 8 and 9, "total count of line elements" amounts to 2, whereas in line no. 7, "total count of line elements" amounts to 7.

If variable k is equal to or less than ("total count of line elements"−1) (step S32: Yes), the process proceeds to step S33. Step S33 calculates the position of the punch dots arranged at pitch T, exemplified as 0.2 mm in the present exemplary embodiment, that resides on and between a given line element Pk and line element Pk+1 within line no. i and adds the calculated punch dots into the draw data buffer. As described earlier, line element Pk denotes line element no. k and line element Pk+1 denotes line element no. k+1. The same denotation applies throughout the description when numberings of lines or elements are generalized by variables such as k and i. Step S34 increments variable k by 1 and returns the process flow to step S32. If variable k exceeds ("total count of line elements"−1) (step S32: No), the process is terminated. The above described process generates the draw data for sequential formation of multiplicity of holes H formed at pitch T along line no. i.

The process flow, then, returns to FIG. 13, and proceeds to step S15 that copies all the draw data, representing the position data of multiplicity of punch dots, written into the draw data buffer into the punch dot buffer. Then, step S16 increments variable i by 1 and the process flow returns to step S12. By repeating step S12 onwards, the draw data is generated for lines identified as draw type punch data, in this case, lines no. 2, 5, 7, 8, 9, and 10. When variable i exceeds the total count of lines, in this case, when i=11, step S12 makes a No decision and terminates the draw data generation process.

After completing the draw data generation process, the process proceeds to step S17 that appends a color change flag into the punch dot buffer. Color change flag is an indication of transition from the draw data to the cut data. Then again, 1 is assigned to variable i that indicates the numbering for identifying the lines at step S19 and the subsequent step S20 determines whether or not variable i is equal to or less than the total count of lines.

If variable i is equal to or less than the total count of lines (step S20: Yes), the process proceeds to step S21 which determines whether or not line no. i is a cut type punch data. If determined to be a draw type punch data (step S21: No), the process proceeds to step S24 and increments variable i by 1 and returns the process flow to step S20. If determined to be a cut type punch data (step S21: Yes), the process proceeds to step S22 and the cut data is generated for forming holes H over line no. i.

The cut data generation process executed at step S22 is broken down into sub steps in the flowchart of FIG. 15. The flowchart begins with step S41 which assigns 1 into variable k that indicates the numbering for identifying a line element provided in a given line number i and clears the cut data buffer. Step S42 determines whether or not variable k is equal to or less than ("total count of line elements"−1). For instance, in line no. 1 of the examples shown in FIGS. 8 and 9, "total count of line elements" amounts to 8.

If variable k is equal to or less than ("total count of line elements"−1) (step S42: Yes), the process proceeds to step S43. Step S43 calculates the position of the punch dots arranged at pitch S, exemplified as 0.1 mm in the present exemplary embodiment, that resides on and between a given line element Pk and line element Pk+1 within line no and adds the calculated punch dots into the cut data buffer. The punch dot may coincide with line element Pk and line element Pk+1. Step S44 increments variable k by 1 and returns the process flow to step S42. If variable k exceeds ("total count of line elements"−1) (step S42: No), the process is terminated. The above described process generates the cut data for sequential formation of multiplicity of holes H spaced by S along line no. i.

The process flow returns to FIG. 13, and proceeds to step S23 that copies all the cut data, representing the position data of multiplicity of punch dots, written into the cut data buffer into the punch dot buffer. Then, step S24 increments variable by 1 and the process flow returns to step S20. By repeating step S20 onwards, the cut data is generated for lines identified as cut type punch data, in this case, lines no. 1, 3, 4, and 6. When variable i exceeds the total count of lines, in this case, when i=11, step S20 makes a No decision and terminates the cut data generation process.

Thus, punch data is created that draws patterns within the bounds or outline of character C and that cuts character C along the outline through formation of multiplicity of small holes H on workplace W. The punch data is a collection of stroke-by-stroke punch position of punch needle 10 which is an equivalent of collection of stroke-by-stroke movement amount of holder 21 in the X and Y directions. As described above, the punch data is generated such that suitable pitch is specified for formation of small hole H for the draw type punch data and the cut type punch data, respectively.

Figure 10:
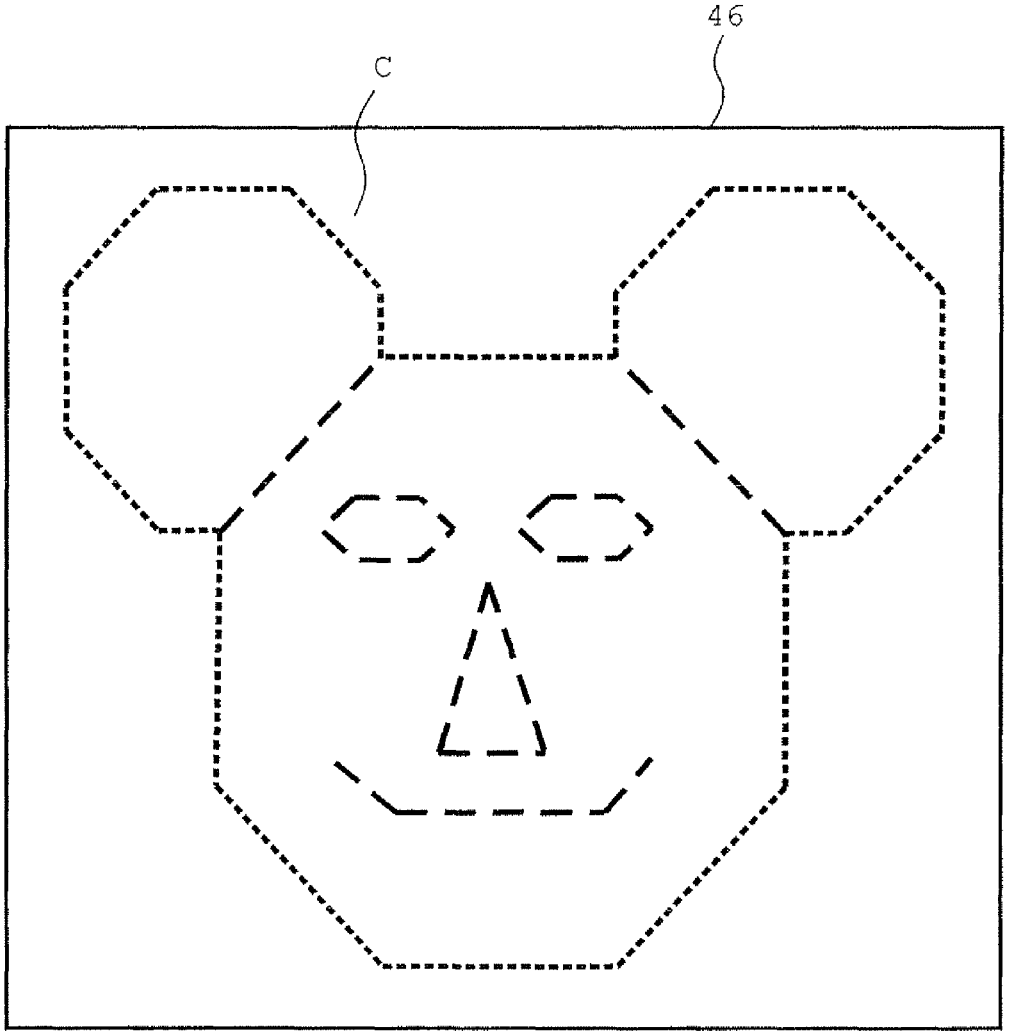
FIG. 10 is an example of how a liquid crystal display shows a state of the workpiece with holes formed on it.

During the punch data generation process, a screen is displayed on LCD 46 that shows an image of character C which is represented by multiplicity of small holes H formed on workpiece W as exemplified in FIG. 10. The images of patterns based on the draw data and the images of outlines based on the cut data are represented differently on the screen. For instance, the pattern images based on the draw data are represented as a collection of broken lines having a length of certain extent, whereas the outline images based on the cut data are represented as a collection of small dots. Such distinction in the presentation of the draw data and the cut data provides good visibility to the user.

In addition to the execution of a normal sewing operation, multi-needle embroidery sewing machine 1 according to the present exemplary embodiment is capable of executing a holing operation on workpiece W such as a sheet of paper by using the punch data generated as described above. In executing the holing operation, the user is to attach punch needle 10 on the number 6 needle bar 8 as well as attaching holder 21 on frame holder 24. Then, the punch data of the desired pattern is selected and read to start the holing operation.

In the present exemplary embodiment, control circuit 41 of multi-needle embroidery sewing machine 1 starts the holing operation by activating sewing machine motor 15 provided that attachment of holder 21 to frame holder 24 has been detected. This means that the holing operation is not permitted when attachment of embroidery frame 20 has been detected, in which case, an error alert is issued. Likewise, the attempt to execute an embroidery sewing operation with the attachment of holder 21 is not permitted and will similarly result in an error alert.

Based on the information provided in the punch data, control circuit 41 selectively drives the number 6 needle bar 8 having punch needle 10 attached to it by way of needle-bar selector motor 17 while moving holder 21 and consequently workpiece W in the X and Y directions through control of transfer mechanism 18. Thus, punch needle 10 is pierced through a predetermined position of workpiece W in the predetermined sequence according to the information provided in the punch data to form multiplicity of small holes H on workpiece W as shown in FIG. 5A.

Figure 11:
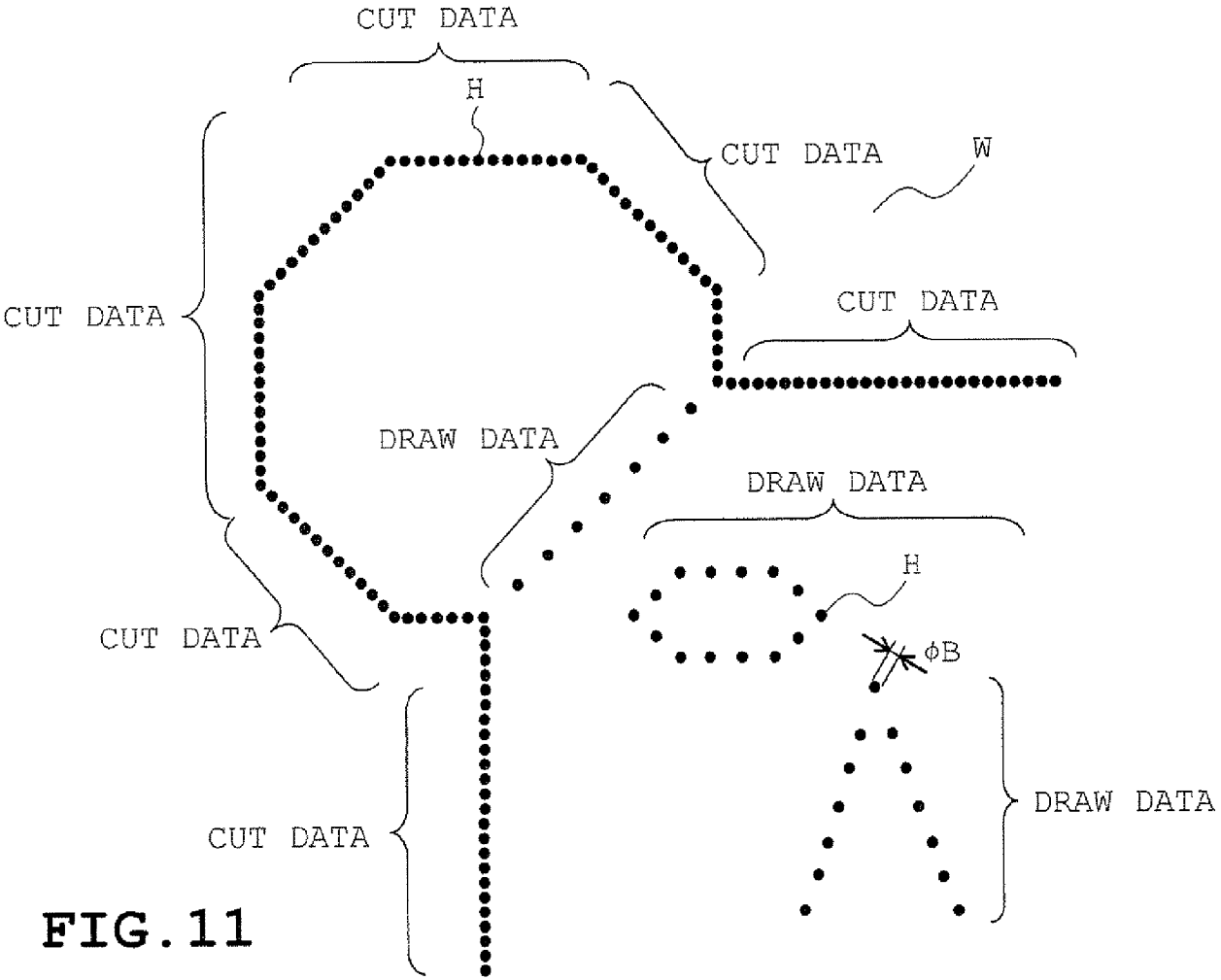
FIG. 11 is an enlarged view partially describing how the small holes are formed on the workpiece.

As exemplified in the exploded view of the left ear portion of character C provided in FIG. 11, the holing execution begins with formation of multiplicity of small holes H on workpiece W in accordance with the information provided in the draw data to draw predetermined patterns, in this case, the facial elements such as the eyes, the nose, and the mouth of character C as well as the boundary between the face and the ears. Then, multiplicity of small holes H are further formed consecutively along the outline of character C based on the cut data. Diameter ϕB indicating the size of small hole H is constant irrespective of whether it is formed for pattern drawing or outline cutting. The pitch at which small holes H are formed varies depending on whether it is formed for pattern drawing or outline cutting, where a predetermined spacing is given between small holes H formed for pattern drawing, whereas small holes H formed in outline cutting is given no spacing between them, meaning that the adjacent small holes H overlaps or is connected to one another.

Thus, as the result of outline cutting, the collection of small holes H exhibit a cut that extends along the outline of character C to allow it to be cut out from workpiece W as shown in FIG. 5B. As for pattern drawing, because the spacing between small holes H or the pitch by which the small holes H are formed are specified at a relatively greater value in the draw data as compared to the cut data, a pattern is successfully formed on workpiece W without cutting workpiece W apart.

The present exemplary embodiment allows multi-needle embroidery sewing machine 1 to be utilized as a device to create patterns on a sheet of workpiece W and as a device to cut workpiece W into the desired shape through formation of small holes H by applying punch needle 10. Because the above configuration does not require optional accessories such as cutter device or a separate cutting plotter, functional advantages offered by such additional devices can be achieved in less cost. Further, because the above configuration allows pattern drawing and cutting to be rendered in sequenced consecutive tasks without having to remove workpiece W during the transition from pattern drawing to cutting, no misalignment occurs between the drawn pattern and the outline along which the pattern is cut.

The present exemplary embodiment further allows multi-needle embroidery sewing machine 1 to function as a punch data generator being subdivided into a draw data generator for generating the draw data and a cut data generator for generating the cut data. Such configuration advantageously allows generation of punch data that enables both drawing of the desired pattern on workpiece W and cutting of workpiece W along the outline of the drawn pattern. Moreover, because pitch S at which small holes H are formed based on the cut data has been configured to be less than pitch T at which small holes H are formed based on the draw data, workpiece W can be cut reliably along the outline by merely providing a single punch needle 10.

A second exemplary embodiment of the present disclosure is described below with reference to FIGS. 16 to 19. In the second exemplary embodiment and in the subsequent exemplary embodiments later described, multi-needle embroidery sewing machine 1 maintains its capacity to execute holing operation on workpiece W based on the punch data. The portions of multi-needle embroidery sewing machine 1, such as the hardware configuration which are common across different exemplary embodiments will bear the same reference symbol and will not be re-illustrated nor re-described. The following description will focus on the features that are unique to each exemplary embodiment.

In the second exemplary embodiment, multi-needle embroidery sewing machine 1 is provided with an accessory of punch needles having tips differing in shape and thickness. Two types of punch needles are provided in this case; punch needle 61 for pattern drawing and punch needle 62 for cutting. Punch needles 61 and 62 are attached to a couple of needle bars selected from the 6 needle bars 8 provided in needle bar case 7. For instance draw punch needle 61 is attached to the leftmost no. 6 needle bar 8 whereas cut punch needle 62 is attached to the adjacent no. 5 needle bar 8. The remaining 4 needle bars 8 each has sewing needle 9 and presser foot 11 attached to them.

Figure 17A:
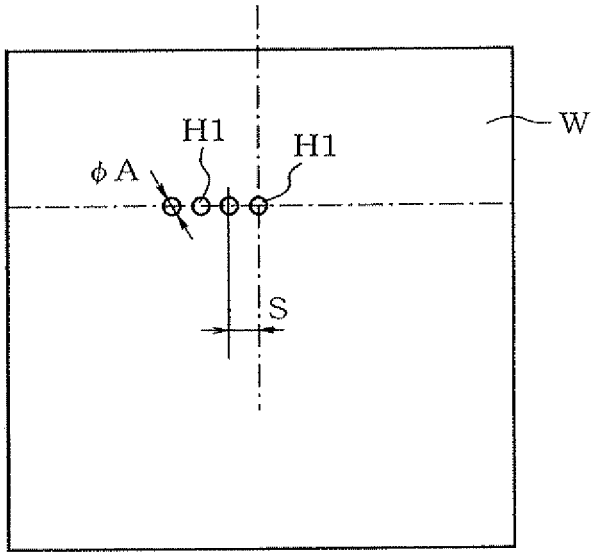
FIG. 17A is a plan view of the workpiece with relatively small sized small holes formed on it.
Figure 17B:
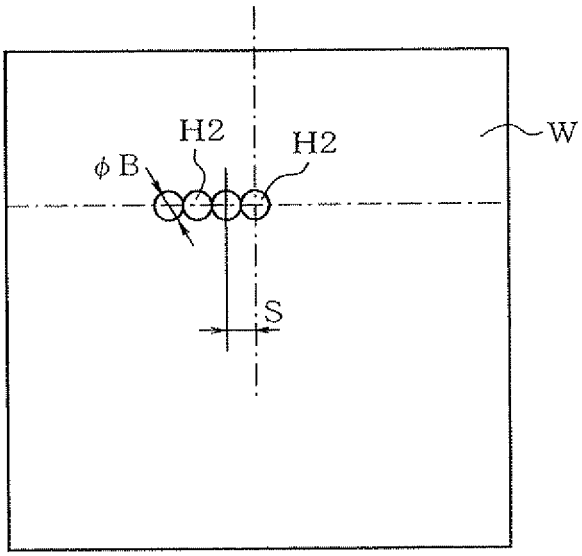
FIG. 17B is a plan view of the workpiece with relatively large sized small holes formed on it.

Draw punch needle 61 has a relatively thinned tip to form relatively small hole H1 on the sheet of workpiece W as can be seen in FIG. 17A. Cut punch needle 62, on the other hand, forms relatively large small hole H2 greater than small hole H1 on the sheet of workpiece W as can be seen in FIG. 17B. For instance, diameter ϕA of small hole H1 is dimensioned to 0.05 mm and diameter ϕB of small hole H2 is dimensioned to 0.1 mm.

In generating draw type punch data, control circuit 41 forms punch data that specifies draw punch needle 61 for execution of the holing operation. In generating cut type punch data, on the other hand, control circuit 41 forms punch data that specifies cut punch needle 62 for execution of the holing operation. In the second exemplary embodiment, the pitch S to be taken between the small holes are set at a constant value such as 0.1 mm for both the draw data and the cut data as shown in FIGS. 17A and 17B, meaning that both holes H1 and H2 are formed at pitch S, respectively.

Figure 18:
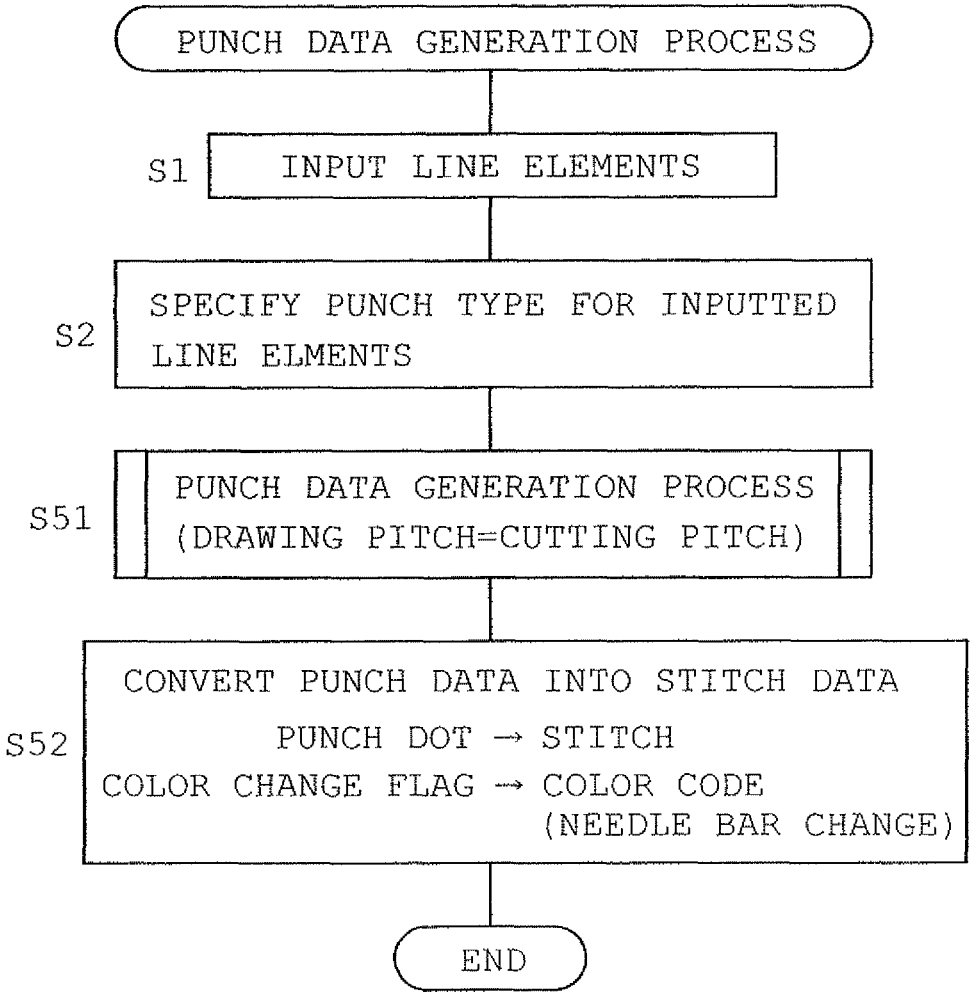
FIG. 18 is a flowchart indicating the process flow of the main routine of the punch data generation process.

Flowchart of FIG. 18 indicates the main routine of the punch data generation process executed by control circuit 41. The process begins with step S1 which inputs the line elements of the lines constituting the pattern, followed by step S2 which specifies the type of punching or the punch data for each line identified as lines no. 1 to 10. The foregoing process flow provides the line data as such exemplified in FIG. 8. Then, subsequent step S51 executes the punch data generation process in which, as mentioned earlier, pitch S taken between small holes H1 formed based on the draw data and pitch S taken between small holes H2 formed based on the cut data are identical to take a constant measurement of, for instance, 0.1 mm. As discussed at step S17 of the flowchart indicated in FIG. 13 of the first exemplary embodiment, color change flag is appended in the punch dot buffer which is an indication of transition from draw data formation to cut data formation.

At step S52 the punch data generated at step S3 which is a collection of position coordinates of the punch dots is converted into stitch data. Stitch data, in this case, is transfer data representing stroke-by-stroke X-directional and Y-directional movement of holder 21 and consequently workpiece W held by holder 21. Further, the color change flag contained in the punch data is replaced by color code data which instructs interchanging of needle bar 8 to complete the punch data generation process.

Figure 19:
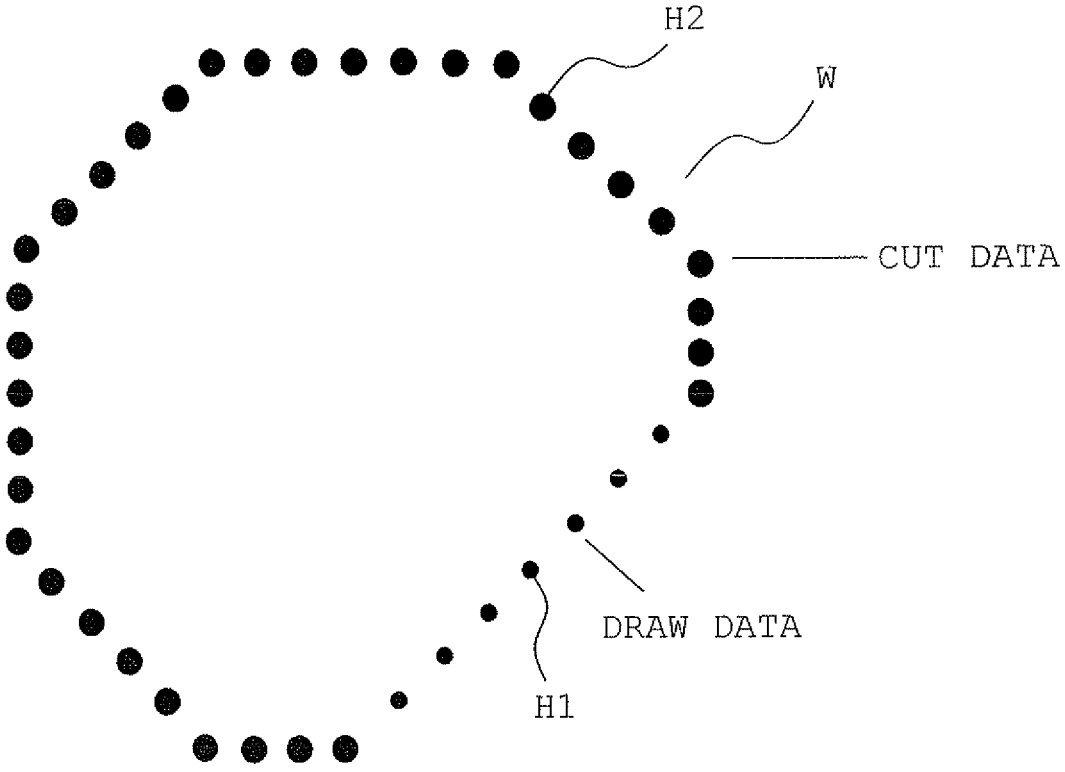
FIG. 19 corresponds to FIG. 11.

As partially exemplified in FIG. 19, the holing execution begins with formation of multiplicity of small holes H1 on workpiece W in accordance with the information provided in the draw data to draw predetermined patterns, in this case, the facial elements such as the eyes, the nose, and the mouth of character C as well as the boundary between the face and the ears. Then, based on the instructions of color code data, needle bar 8 is switched from needle bar no. 6 to no. 5 by the activation of needle-bar selector motor 17. Then, based on the cut data, multiplicity of small holes H2 are formed on workpiece W consecutively along the outline of character C using cut punch needle 62.

Though both small holes H1 for pattern drawing and small holes H2 for outline cutting are formed at constant pitch S, the size of small hole H1 and small hole H2 varies where small hole H1 has diameter ϕA whereas, small hole H2 has diameter ϕB. Thus, in pattern drawing, small holes H1 are spaced by a certain distance, whereas in outline cutting, each of the multiplicity of small holes H2 are connected to the adjacent small holes H2. Thus, the collection of small holes H2 exhibits a cut that extends along the outline to allow character C to be cut out from workpiece W. Because small holes H1 formed based on the draw data have relatively larger spacing between the adjacent holes H1, a pattern is successfully formed on workpiece W without cutting workpiece W apart.

According to the above described second exemplary embodiment, punch data is generated that executes the holing operation on a sheet of workpiece W by utilizing multi-needle embroidery sewing machine 1 as was the case in the first exemplary embodiment. The generated punch data allows both desired pattern drawing on workpiece W as well as cutting workpiece W along the outline of the drawn pattern.

Further, the holing operation based on the draw data is executed by forming small hole H1 using draw punch needle 61, whereas holing operation based on the cut data is executed by forming small hole H2 larger in size than small hole H1 using cut punch needle 62. Thus, a pattern can be reliably drawn on and cut out from workpiece W by using either punch needles 61 or 62 that is suitable for the intended purpose. Further, because a given size of workpiece W can be cut by relatively less number of small holes H2 formed in pattern cutting, the second exemplary embodiment yields an advantage of efficient pattern cutting.

Figure 20:
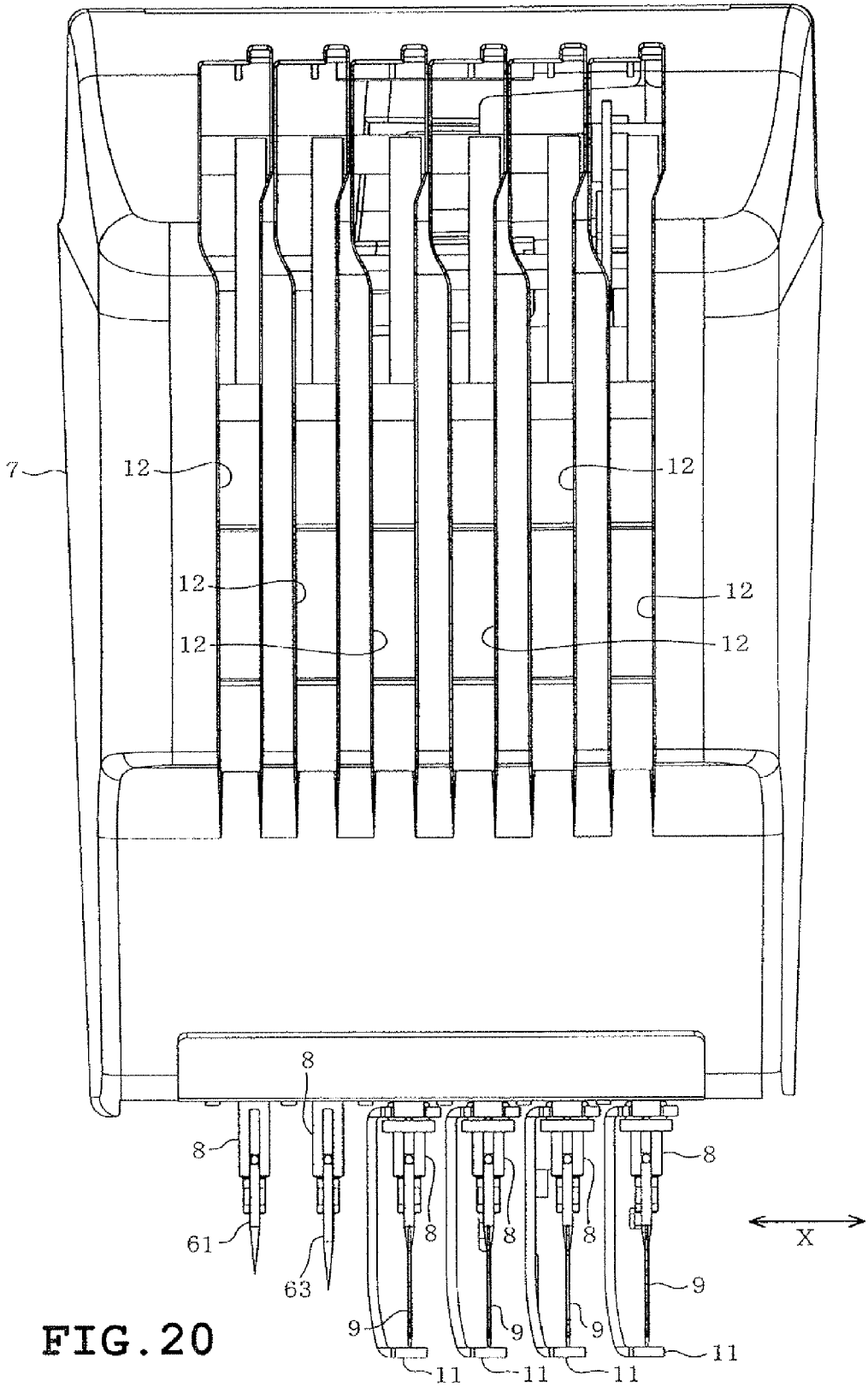
FIG. 20 corresponds to FIG. 2 and indicates a third exemplary embodiment of the present disclosure.
Figures 21A, 21B:
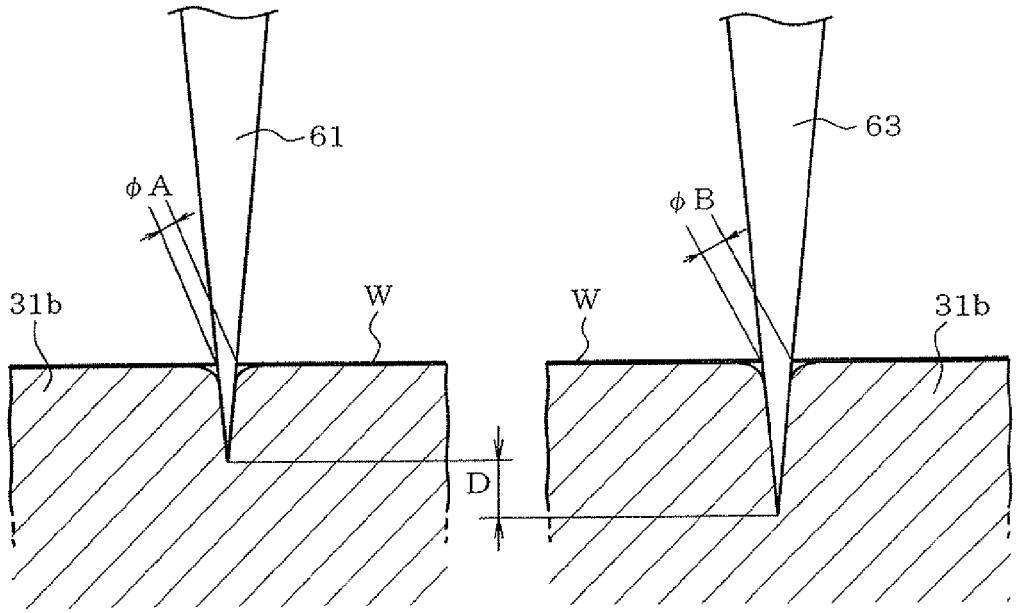
FIG. 21A is a vertical cross sectional view indicating the case where the penetration of a punch needle into the workpiece during the holing operation is relatively shallow.
FIG. 21B is a vertical cross sectional view indicating the case where the penetration of the punch needle into the workpiece during the holing operation is relatively deep.

FIGS. 20, 21A and 21B illustrate a third exemplary embodiment. In the third exemplary embodiment, draw punch needle 61 is attached to the no. 6 needle-bar 8 among the 6 needle bars 8 provided in needle bar case 7. The adjacent no. 5 needle bar 8 has cut punch needle 63 attached to it. As described in the second exemplary embodiment and as also shown in FIG. 21A, draw punch needle 61 is configured to form relatively small hole H1 on workpiece W which has a diameter ϕA which may measure, for instance, 0.05 mm.

Cut punch needle 63 shown in FIG. 21B, on the other hand, has a sharpened tip or lower end just like draw punch needle 61 except that the upper side of the tip is longer than the corresponding portion of draw punch needle 61 by length D. Thus, as shown in FIGS. 21A and 21B, cut punch needle 63 penetrates deeper below workpiece W as compared to draw punch needle 61. Thus, the size of small hole H2 formed by cut punch needle 63 having a diameter ϕB of 0.1 mm, for example, is larger than small hole H1 formed by draw punch needle 61. Again, both small holes H1 formed based on the draw data and small holes H2 formed based on the cut data are formed at pitch S measuring 0.1 mm for example.

Thus, the third exemplary embodiment, as was the case in the second exemplary embodiment, forms punch data that allows drawing of a predetermined pattern on workpiece W and cutting of workpiece W along the outline of the drawn pattern. A pattern can be reliably illustrated on and cut out from workpiece W by using punch needle 61 or 63 that is suitable for the intended purpose. Further, because a given size of workpiece W can be cut by relatively less number of small holes H2 formed in pattern cutting, the third exemplary embodiment yields an advantage of efficient pattern cutting.

A fourth exemplary embodiment will be described hereinafter with reference to FIGS. 22A to 28 focusing on the differences from the first exemplary embodiment. Mechanical elements such as multi-needle embroidery sewing machine 1, holder 21, and punch needle 10 illustrated in FIGS. 1 to 4, and electrical configurations primarily implemented by control circuit 41 are substantially the same as the first exemplary embodiment. Such common features will bear the same reference symbol and will not be re-illustrated nor re-described.

The configuration and working of the fourth exemplary embodiment will also be described through an example of generating the punch data for drawing character C onto workpiece W and cutting out character C from workpiece W. As exemplified in FIG. 9, character C represents a mouse with big ears. As was the case in the foregoing exemplary embodiments, punch data is generated for illustrating facial elements of character C such as the eyes, the nose, and the mouth as well as the boundary between the face and the ears on workpiece W and for cutting out the drawn pattern from workpiece W.

As was the case in the foregoing exemplary embodiments, in addition to the execution of a normal sewing operation, multi-needle embroidery sewing machine 1 according to the fourth exemplary embodiment is capable of executing the holing operation on workpiece W based on the punch data and generating the punch data. As can be seen in FIGS. 22A to 22D, the holing operation allows drawing of a predetermined pattern on workpiece W and cutting workpiece W into a predetermined shape by at least consecutively forming small holes H along the outline of the drawn pattern.

As will be later described with flowcharts, control circuit 41 according to the fourth exemplary embodiment functions as a cut data generator, data divider, and draw data generator through execution of the punch data generating program. The punch data includes two types of data namely, the draw data and the cut data as described in the foregoing exemplary embodiments. The fourth exemplary embodiment is unique in that the cut data is further subdivided into primary cut data and secondary cut data.

Figure 23A:
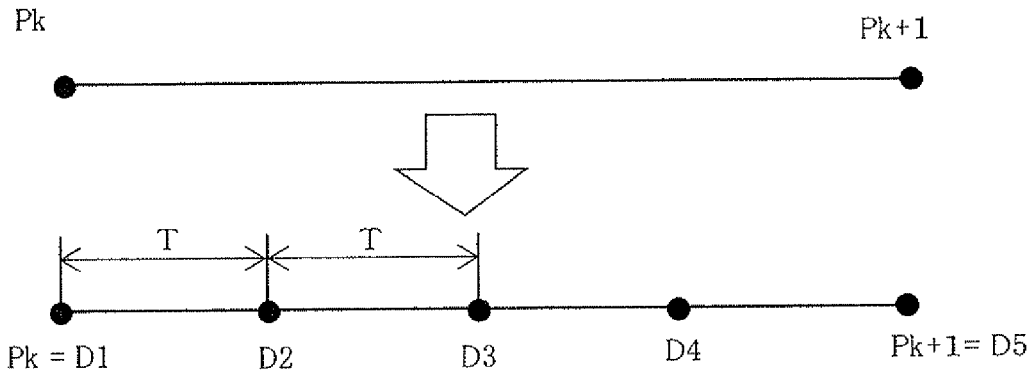
FIG. 23A is a descriptive view for explaining the spacing or the pitch at which the small holes formed on the workpiece based on the draw data.
Figure 23B:
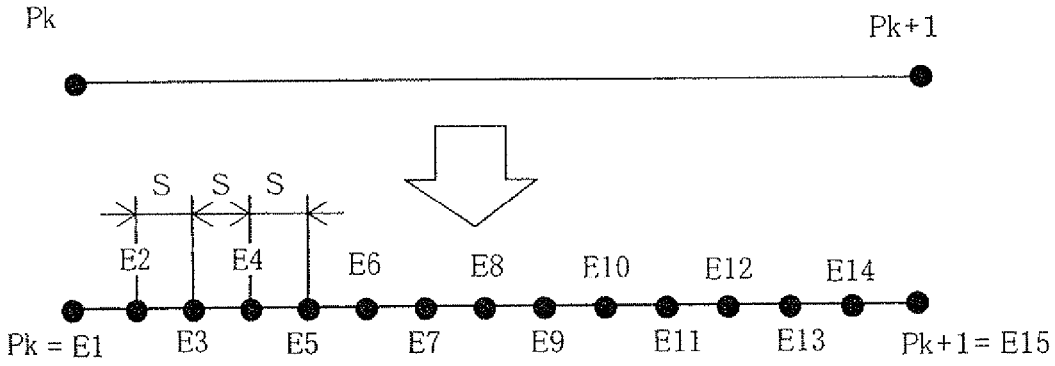
FIG. 23B is a descriptive view for explaining the spacing or the pitch at which the holes formed on the workpiece based on the cut data.

In the fourth exemplary embodiment, control circuit 41 specifies the position of the punch dots so that spacing/pitch between small holes H formed in the holing operation varies depending upon whether the holing operation is based on the draw data or the cut data. To elaborate, in case of a draw type punch data, pitch T, measuring 0.2 mm for example, based upon which the punch dots are positioned on the lines of the pattern to be drawn, is specified so as to be greater than diameter ϕB as can be seen in FIG. 23A. In case of a cut type punch data, pitch T, measuring 0.1 mm for example, based upon which the punch dots are positioned on the lines of the pattern to be drawn is specified so as to be equal to or less than diameter ϕB as can be seen in FIG. 23B.

Control circuit 41 generates the cut data in two different groups, the first group being the primary cut data and the second group being the secondary cut data. Among the punch dots to be processed as the cut data, the primary cut data is responsible for generating uncut portions on the outline that is free of small holes H. Such uncut portions, being free of small holes H, are formed intermittently over the outline. The uncut portion temporary prevents the outline from being cut out from workpiece W to allow holing operation to be executed for punch dots residing outside the uncut portion. The secondary cut data is responsible for execution of the holing operation after execution of holing operation based on the primary cut data to form small holes on the uncut portion.

The cut data is grouped into the primary cut data and the secondary cut data in the following series of steps. As the first step, all the punch dots to be processed as cut data are divided into a unit of N ($N \geq 2$) number of consecutive punch dots overlying the outline. Then, among the N number of punch dots, M ($M<N$) number of punch dots are grouped as the secondary cut data, and finally, the remaining number ($N-M$) of punch dots are grouped as the primary cut data. The above grouping process repeats itself. According to the forth exemplary embodiment, 1 out of 2 punch dots, in this case, the punch dots numbered in even numbers constituting each of the lines are grouped as the secondary cut data and the remaining punch data numbered in odd numbers are grouped as the primary cut data. The process repeats itself thereafter.

Number N and M can be specified as appropriate, so that 1 out of 4 punch dots may be grouped as the secondary cut data or 2 out of 10 punch dots may be grouped as the secondary cut data, etc. According to the fourth exemplary embodiment, holing operation basically progresses in the sequence of the draw data, primary cut data, and finally, the secondary cut data. The sequence of the draw data and the primary cut data may be rearranged, meaning that the processing of primary cut data may precede the draw data or the draw data and the primary cut data may be processed in mixed sequence. However, the holing operation based on the secondary cut data must always be the last in the sequence, meaning that the holing operation based on the draw data must always precede the holing operation based on the secondary cut data.

In generating or editing the punch data, control circuit 41 displays images of small holes H formed on workpiece W on LCD 46. The image of patterns based on the draw data and the image of outlines based on the cut data are represented differently so that they can be distinguished on the screen.

The operation of the above described configuration is described hereinafter.

The operation is, again, described through an example of generating punch data for illustrating character C onto workpiece W and cutting out character C from workpiece W as shown in FIG. 9 of the first exemplary embodiment. Character C represents a mouse with big ears. As was the case in the foregoing exemplary embodiments, punch data is generated for drawing facial elements of character C such as the eyes, the nose, and the mouth as well as the boundary between the face and the ears on workpiece W and for cutting out the drawn pattern from workpiece W. The line data of character C shown in FIG. 9 is configured as shown in FIG. 8.

Based on user's selection for instance, control circuit 41 extracts the lines constituting a given pattern from the image data of the patterns stored in external memory 44 or ROM 42. Then, based on the line data of the extracted line, punch data generation process or punch data generation mode is executed in which a plurality of holing positions or punch dots is specified along the extracted lines. The flowcharts shown in FIGS. 24 to 27 indicate the process flow of punch data generation process executed by control circuit 41.

Figure 24:
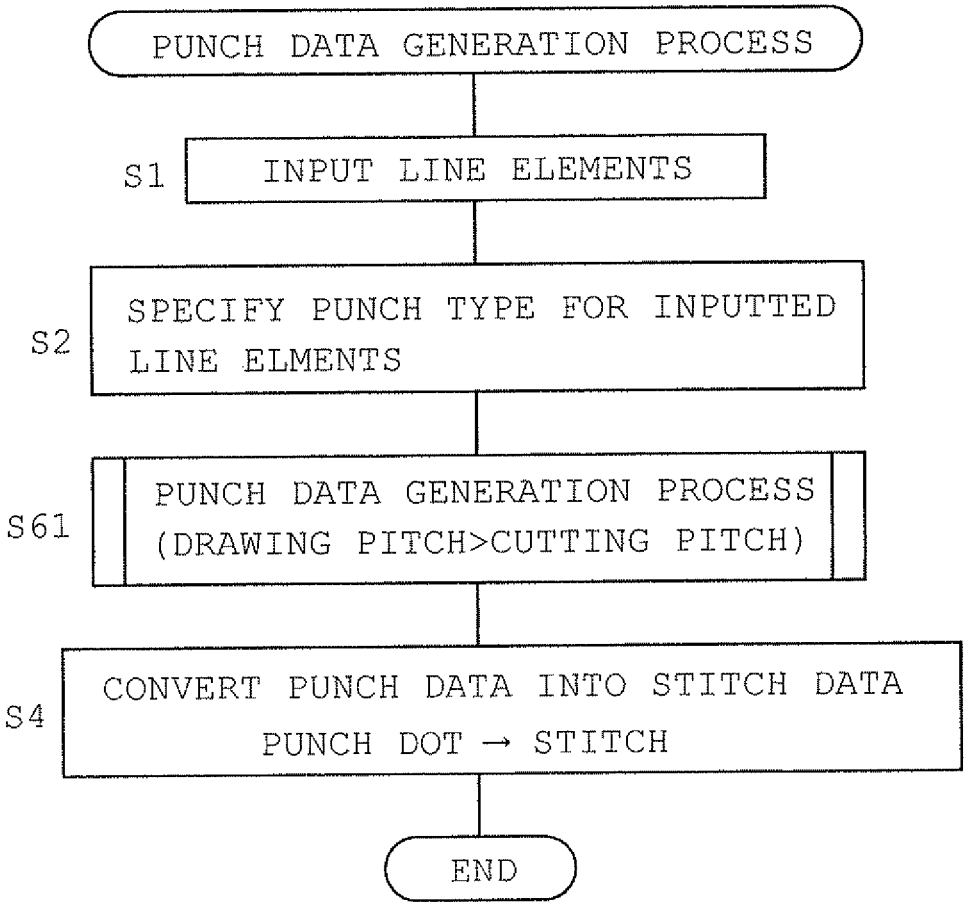
FIG. 24 is a flowchart indicating the process flow of the main routine of the punch data generation process executed by the control circuit.
Figure 25A:
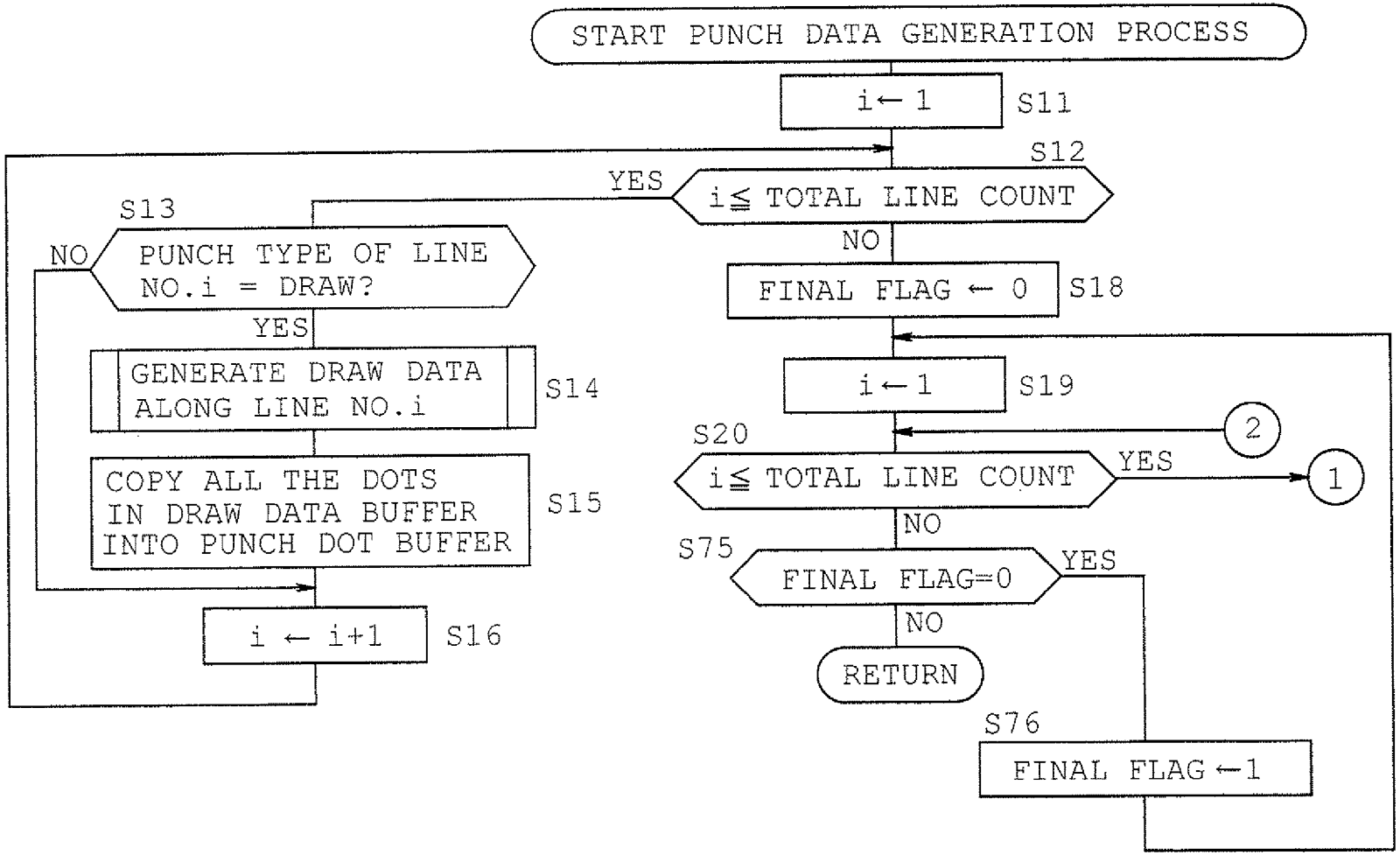
FIGS. 25A and 25B taken together indicate a flowchart detailing step S61 of the flowchart of FIG. 24.
Figure 25B:
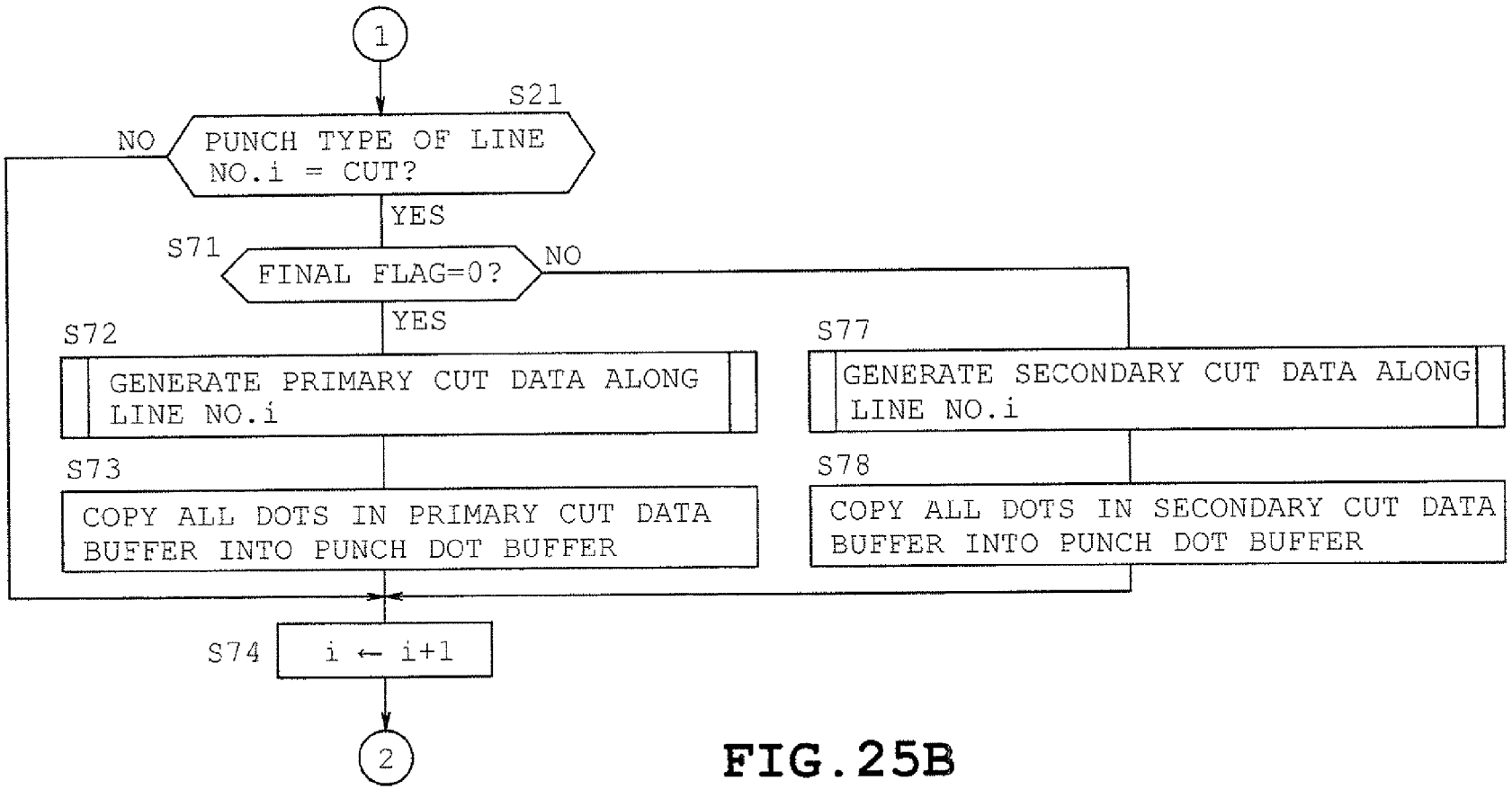
Figure 26:
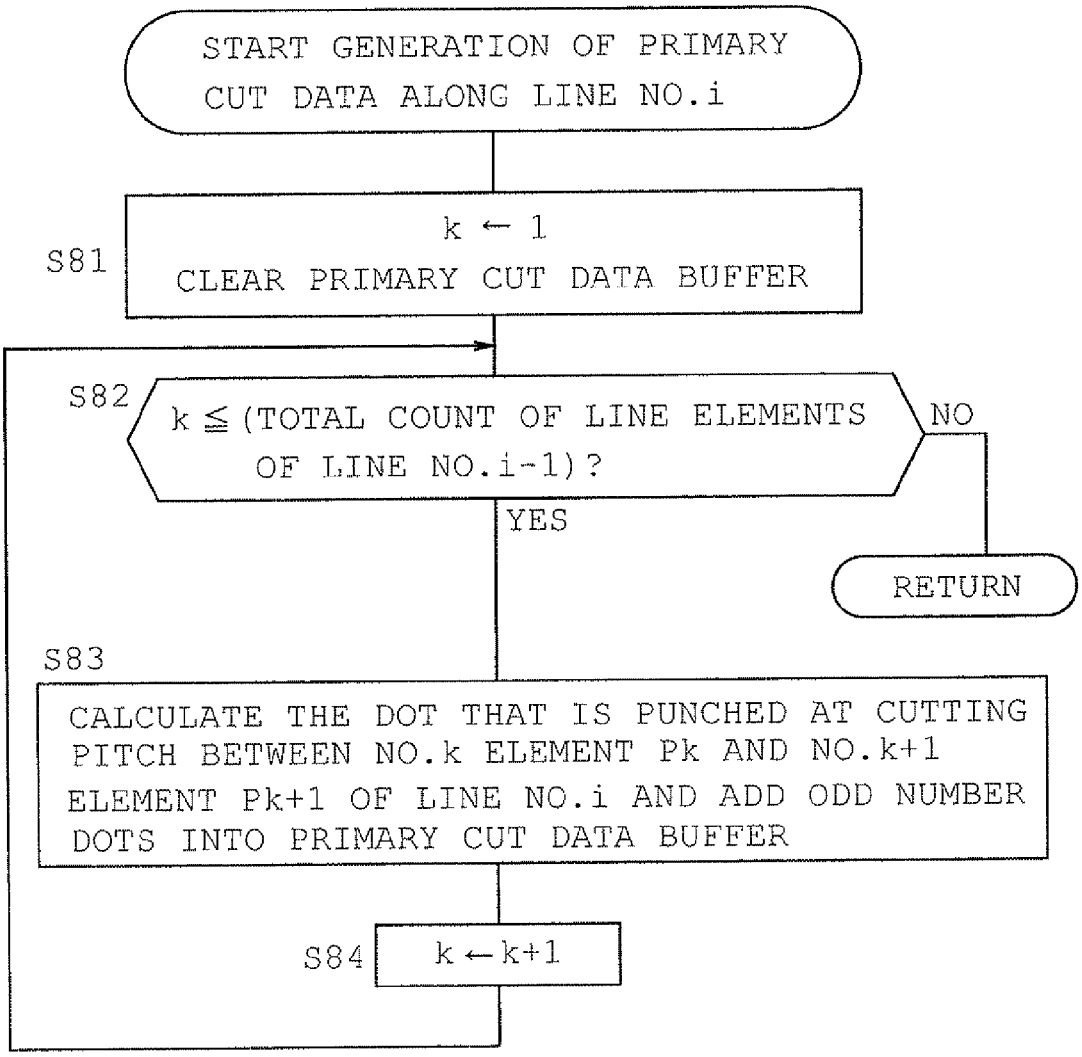
FIG. 26 is a flowchart detailing step S72 of the flowchart of FIG. 25B.
Figure 27:
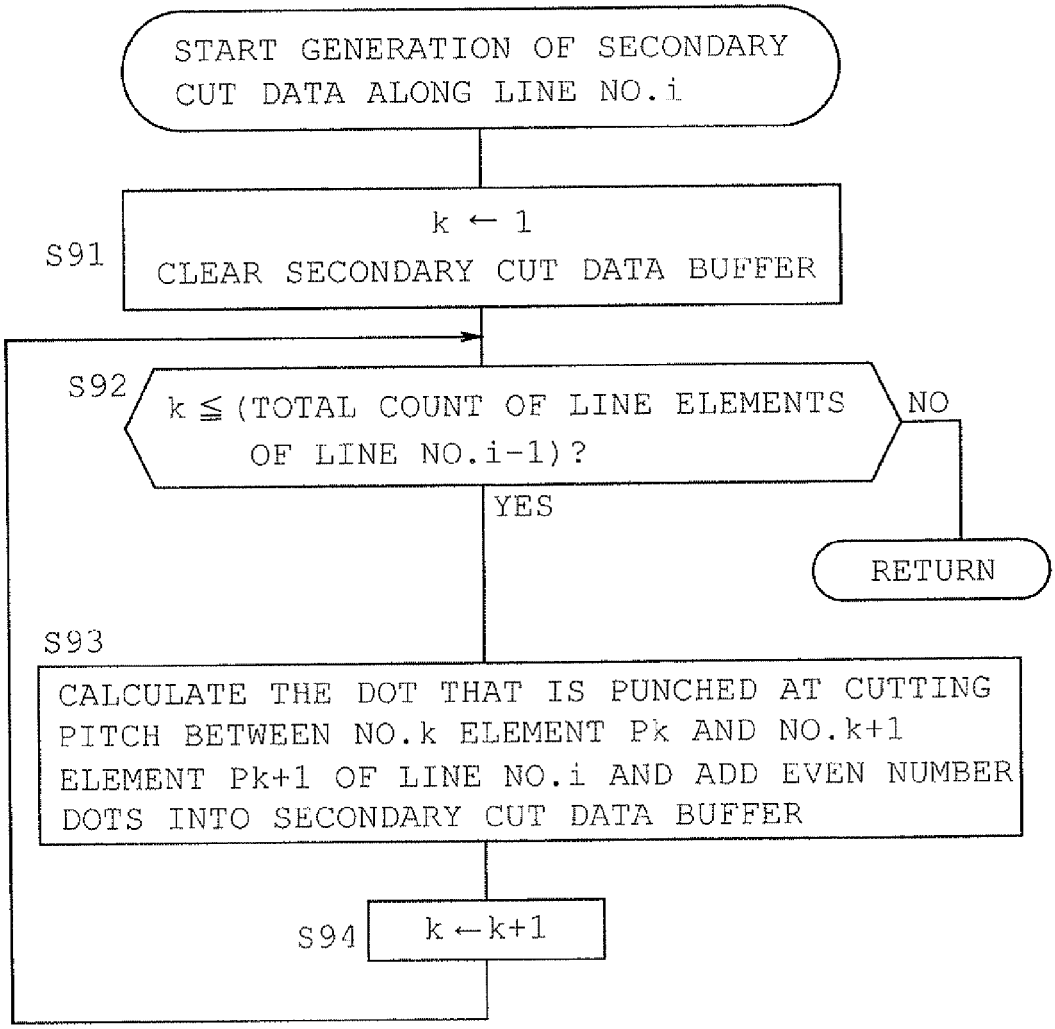
FIG. 27 is a flowchart detailing step S77 of the flowchart of FIG. 258.

Among them, flowchart of FIG. 24 indicates the main routine. The flowcharts of FIGS. 25A and 25B show the details of the punch data generation process identified as step S61 in FIG. 24. The flowchart of FIG. 26 shows the details of the primary cut data generation process identified as step S72 in FIG. 25B. The flowchart of FIG. 27 shows the details of the secondary cut data generation process identified as step S77 in FIG. 25B.

Among the steps identified in the flowcharts of FIGS. 24 and 25, the steps that are substantially the same as those described in flowcharts of FIGS. 12 and 13 of the first exemplary embodiment are identified with the same step number and only briefly explained. Because the details of the draw data generation process of step S14 indicated in flowchart of FIG. 25A has already been elaborated in FIG. 14, it will not be explained.

The flowchart of FIG. 24 begins with step S1 which inputs the line elements of the lines constituting the pattern to obtain the line data. Step S1 is followed by step S2 in which the type of punch data is specified for each line, in this case, for line numbers 1 to 10. Then, at step S61, the punch data is generated based on the line data. The details of the punch data generation process will be revisited in detail in the flowcharts of FIGS. 25A and 25B. Step S4 converts the punch data generated at step S61 into stitch data that is, stroke-by-stroke transfer data indicating the amount of X direction or Y direction movement of holder 21 and consequently workpiece W to complete the punch data generation process.

Referring now to the flowcharts of FIGS. 25A to 27, the punch data generation process will be described in detail. The flowchart of FIG. 25A begins with step S11 in which 1 is assigned to variable i that indicates the line number. Then, step S12 determines whether variable i is equal to or less than the total count of lines. If variable i is equal to or less than the total count of lines, in this case, 10 (step S12: Yes), the process proceeds to step S13 which determines whether or not the $i^{th}$ line, or line number i is a draw type punch data. If determined to be a cut type punch data (step S13: No), the process proceeds to step S16 which increments variable i by 1 and returns the process flow back to step S12. If determined to be a draw type punch data (step S13: Yes), the process proceeds to step S14 and draw data is generated for forming holes H over line no. i.

The draw data generation process executed at step S14 is as described in the flowchart of FIG. 14 of the above described first exemplary embodiment. Step S33 of the flowchart of FIG. 14, calculates the position of the punch dots arranged at pitch T, exemplified as 0.2 mm, that resides on and between a given line element Pk and line element Pk+1 within line no. i and adds the calculated punch dots into the draw data buffer. This process carried out in the present exemplary embodiment obtains dots D1, D2, D3, D4, and D5 shown in FIG. 23A as the punch dots residing on and between line element Pk and line element Pk+1 which are added to the draw data buffer as the punch data.

The process flow returns to FIG. 25A, and proceeds to step S15 that copies all the draw data, representing the position data of multiplicity of punch dots, written into the draw data buffer into punch dot buffer. Then, step S16 increments variable i by 1 and the process flow returns to step S12. By repeating step S12 onwards, the draw data is generated for lines identified as draw type punch data, which are, in the example of FIG. 8, lines no. 2, 5, 7, 8, 9, and 10.

When variable i exceeds the total count of lines, in this case, when i=11, step S12 makes a No decision and terminates the draw data generation process. After completing the draw data generation process, the process proceeds to step S18 that sets 0 to the end flag. Then again, 1 is assigned to variable i that indicates the numbering for identifying the lines at step S19 and the subsequent step S20 determines whether or not variable is equal to or less than the total count of lines.

If variable i is equal to or less than the total count of lines (step S20: Yes), the process proceeds to step S21 which determines whether or not line no. i is a cut type punch data. If determined to be a draw type punch data (step S21: No), the process proceeds to step S74 and increments variable i by 1 and returns the process flow to step S20. If determined to be a cut type punch data (step S21: Yes), the process proceeds to step S71 to determine whether or not the end flag is set to 0. If the end flag is set to 0 (step S71: Yes), the process proceeds to step S72 and generation of the primary cut data is executed for line no. i.

The primary cut data generation process for line no. i executed at step S72 is broken down into sub steps in flowchart of FIG. 26. The flowchart begins with step S81 which assigns 1 into variable k that indicates the numbering for identifying the line element provided in a given line number i and clears the primary cut data buffer. Step S82 determines whether or not variable k is equal to or less than ("total count of line elements"−1). For instance, in line no. 1 of the examples shown in FIGS. 8 and 9, "total count of line elements" amounts, for instance, to 8.

If variable k is equal to or less than ("total count of line elements"−1) (step S82: Yes), the process proceeds to step S83. Step S83 calculates the position of the punch dots arranged by pitch S, exemplified as 0.1 mm in the present exemplary embodiment, that resides on and between a given line element Pk and line element Pk+1 within line no. i and adds the odd number punch dots into the primary cut data buffer. The above described process recognizes punch dots E1 to E15 on and between line element Pk and line element Pk+1 as indicated in FIG. 23B. Among the recognized punch dots, the odd number punch dots E1, E3, E5, . . . E15 are added to the primary cut data buffer as punch dots to be grouped as primary cut data.

Figure 28A:
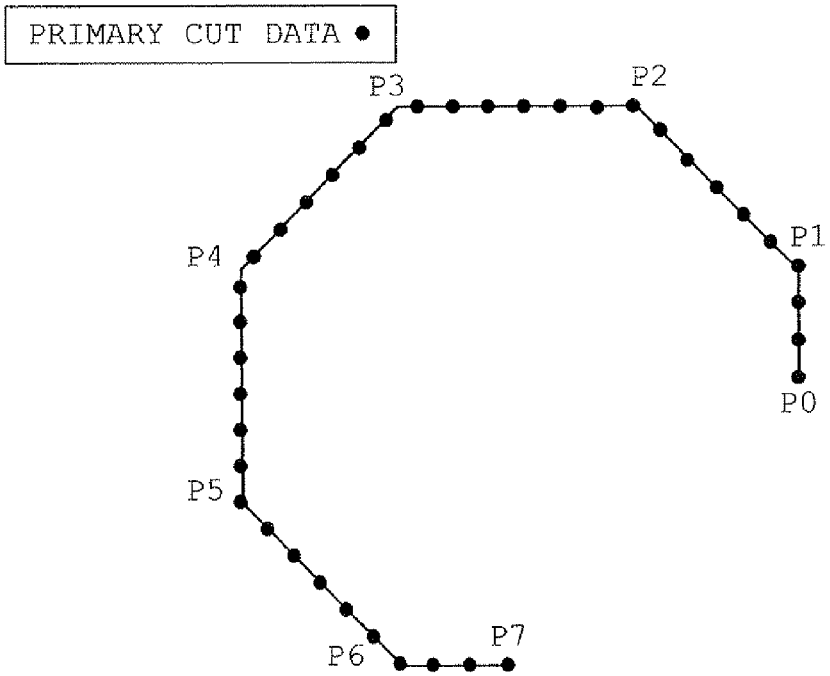
FIG. 28A is a descriptive view for explaining the holing operation based on the primary cut data.
Figure 28B:
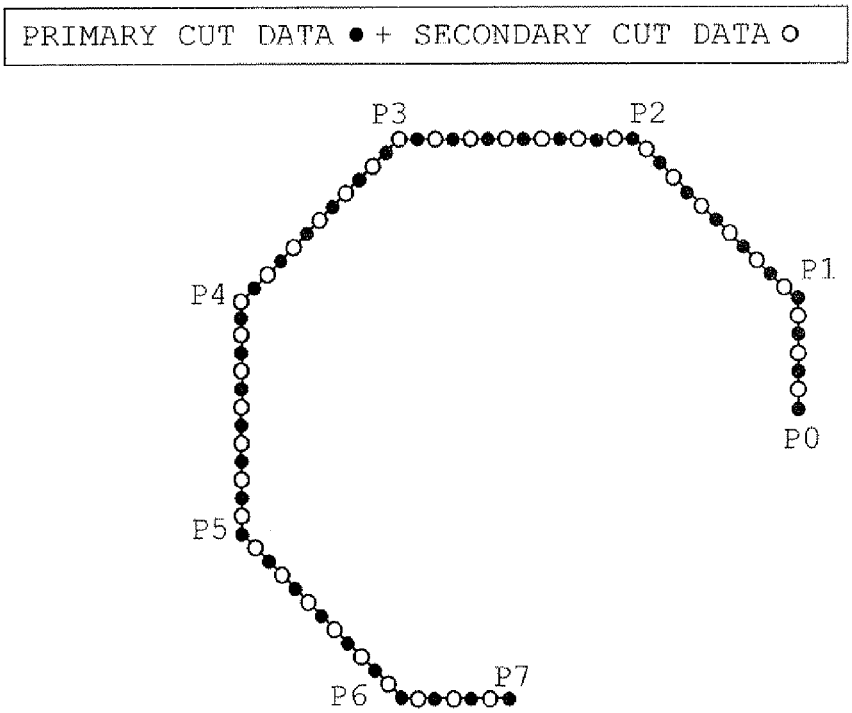
FIG. 28B is a descriptive view for explaining the holing operation based on the secondary cut data.

Step S84 increments variable k by 1 and returns the process flow to step S82. If variable k exceeds ("total count of line elements"−1) (step S82: No), the process is terminated. The above described process generates the primary cut data for sequential formation of multiplicity of holes H formed at pitch S along line no. i as partially shown in FIGS. 28A and 28B. In FIGS. 28A and 28B, the outline of the left ear of character C is illustrated such that the location of punch dots grouped into the primary cut data are indicated by black dots and the punch dots grouped into the later described secondary cut data are indicated by white dots.

The process flow returns to FIG. 25B, and proceeds to step S73 that copies all the primary cut data, representing the position data of multiplicity of punch dots, written into the primary cut data buffer into punch dot buffer. Then, step S74 increments variable i by 1 and the process flow returns to step S20. By repeating step S20 onwards, the primary cut data is generated for lines identified as cut type punch data, in this case, lines no. 1, 3, 4, and 6. When variable i exceeds the total count of lines, in this case, when i=11, step S20 makes a No decision and proceeds to step S75.

Step S75 determines whether or not 0 is set to the end flag. If determined that 0 is set to the end flag (step S75: Yes), the process proceeds to step S76, sets 1 to the end flag and returns the process flow to step S19. Step S19 specifies 1 to variable i that indicates the line number, which is followed by step S20 that determines whether or not variable i is equal to or less than the total count of lines. If variable i is equal to or less than the total count of lines (step S20: Yes), the process proceeds to step S21 which determines whether or not line no. i is a, cut type punch data. If determined to be a cut type punch data (step S21: Yes), the process proceeds to step S71 to determine whether or not the end flag is set to 0.

As mentioned earlier, because the end flag is set to 1 if generation of the primary cut data has been completed, step S71 makes a No decision and proceeds to step S77. Step S77 executes generation of secondary cut data for line no. i.

The secondary cut data generation process for line no. i executed at step S77 is broken down into sub steps in flowchart of FIG. 27. The flowchart begins with step S91 which assigns 1 into variable k that indicates the numbering for identifying a line element provided in a given line number i and clears the secondary cut data buffer. Step S92 determines whether or not variable k is equal to or less than ("total count of line elements"−1). If variable k is equal to or less than ("total count of line elements"−1) (step S92: Yes), the process proceeds to step S93. Step S93 calculates the position of the punch dots arranged at pitch S, exemplified as 0.1 mm in the present exemplary embodiment, that resides on and between a given line element Pk and line element Pk+1 within line no. i and adds only the even number punch dots into the secondary cut data buffer.

In the example indicated in FIG. 23B, among the dots E1 to E15 recognized as punch data on and between line element Pk and line element Pk+1, the even number punch dots E2, E4, E14 are added to the secondary cut data buffer as punch dots to be grouped as the secondary cut data. Step S94 increments variable k by 1 and returns the process flow to step S92. If variable k exceeds ("total count of line elements"−1) (step S92: No), the process is terminated. The above described process generates the secondary cut data partially represented by white dots in FIG. 28B for sequential formation of multiplicity of holes H formed at ptich S along line no. i as partially shown in FIG. 28B.

The process flow returns to FIG. 25B, and proceeds to step S78 that copies all the secondary cut data, representing the position data of multiplicity of punch dots, written into the secondary cut data buffer into punch dot buffer. Then, step S74 increments variable i by 1 and the process flow returns to step S20. By repeating step S20 onwards, generation of the secondary cut data is completed. When variable exceeds the total count of lines, in this case, when i=11, step S20 makes a No decision and proceeds to step S75. This time, because the end flag is 1 (step S75: No), processing relating to punch data generation is completed.

Thus, punch data is created that draws patterns within the bounds or the outline of character C and that cuts character C along the outline through formation of multiplicity of small holes H on workpiece W. The punch data is a collection of stroke-by-stroke punch position of punch needle 10 which is an equivalent of collection of stroke-by-stroke movement amount of holder 21 in the X and Y directions. As described above, the punch data is generated such that suitable pitch is specified for formation of small hole H for draw type punch data and the cut type punch data, respectively. The cut type punch data is further grouped into the primary cut data and the secondary cut data. The holing operation based on the foregoing types of punch data progresses in the listed sequence of: holing operation based on the draw data, holing operation based on the primary cut data, and holing operation based on the secondary cut data.

In addition to the execution of a normal sewing operation, multi-needle embroidery sewing machine 1 according to the present exemplary embodiment is capable of executing a holing operation on workpiece W such as a sheet of paper by using the punch data generated as described above. In executing the holing operation, the user is to attach punch needle 10 on the number 6 needle bar 8 as well as attaching holder 21 on frame holder 24. Then, the punch data of the desired pattern is selected and loaded to start the holing operation.

In the present exemplary embodiment, control circuit 41 of multi-needle embroidery sewing machine 1 starts the holing operation by activating sewing machine motor 15 provided that attachment of holder 21 to frame holder 24 has been detected by frame-type detection sensor 40. This means that the holing operation is not permitted when attachment of embroidery frame 20 has been detected, in which case, an error alert is issued. Likewise, the attempt to execute an embroidery sewing operation with the attachment of holder 21 is not permitted and will similarly result in an error alert.

Based on the information provided in the punch data, control circuit 41 selectively drives the number 6 needle bar 8 having punch needle 10 attached to it by way of needle-bar selector motor 17 while moving holder 21 and consequently workpiece W in the X and Y directions through control of transfer mechanism 18 to execute the holing operation. Thus, punch needle 10 is pierced through a predetermined position of workpiece W in the predetermined sequence according to the information provided in the punch data to form multiplicity of small holes H on workpiece W. The sequence of forming of small holes H on workpiece W is illustrated in FIG. 22A to FIG. 22D.

Figure 22A:
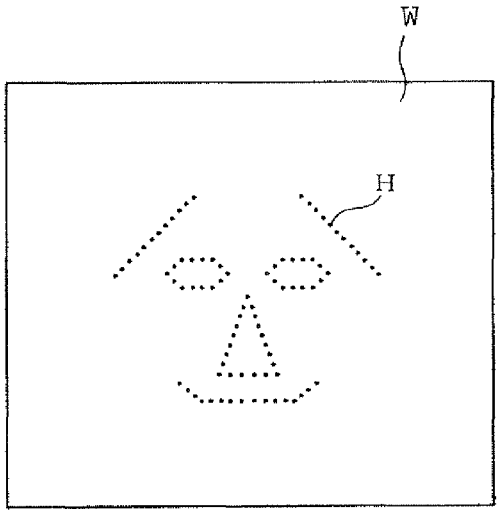
FIG. 22A indicates a fourth exemplary embodiment of the present disclosure and is a plan view showing the workpiece with small holes formed on it based on draw data.
Figure 22B:
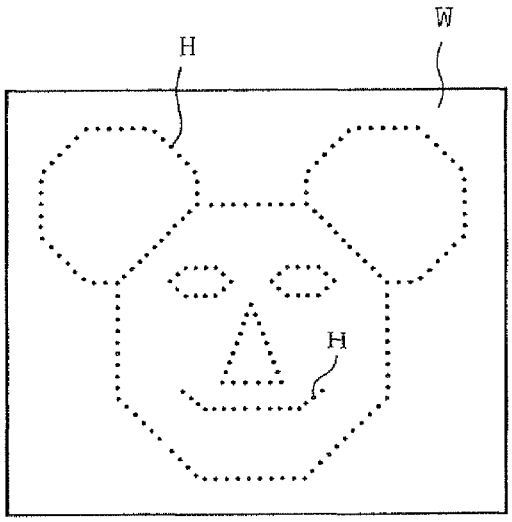
FIG. 22B is a plan view showing the workpiece with small holes formed on it based on primary data.

Formation of small holes H begins with holing operation based on the draw data. As shown in FIG. 22A, predetermined patterns of character C including facial elements such as the eyes, nose, and mouth, and the boundaries between the face and the ears are drawn by small holes H. Then, the holing operation based on the primary cut data is executed to form small holes H along the outline of character C. As shown in FIGS. 22B and 22A, among the punch dots ultimately grouped as the cut data, small holes H are generated only for the odd number punch dots, meaning that every other punch dot is pierced into small hole H at this point in time. This produces uncut portion free of small holes H to be formed intermittently on workpiece W along the outline. The uncut portion serves as a bridge across the inside and the outside of the outline.

Figure 22C:
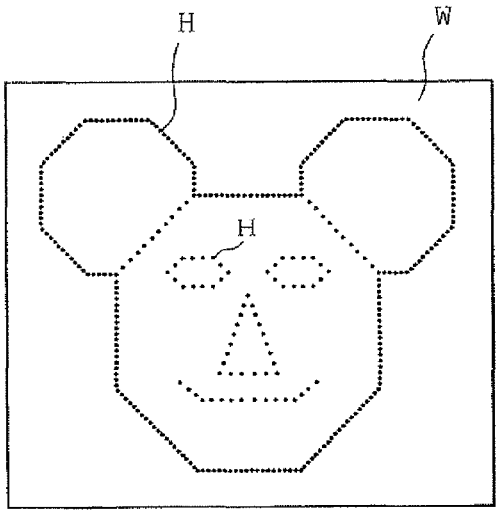
FIG. 22C is a plan view showing the workpiece with small holes formed on it based on secondary data.

Thereafter, the holing operation is executed on the uncut portion remaining on the outline based on the secondary cut data. Thus, as shown in FIG. 22C and FIG. 28B, for the remaining punch dots grouped as the cut data, small holes H are generated along the outline of character C for the remaining even number punch dots represented by white dots in FIG. 28B. As a result, multiplicity of small holes H connected with the adjacent small holes H are formed consecutively along the outline of character C as can be seen in FIG. 11.

Figure 22D:
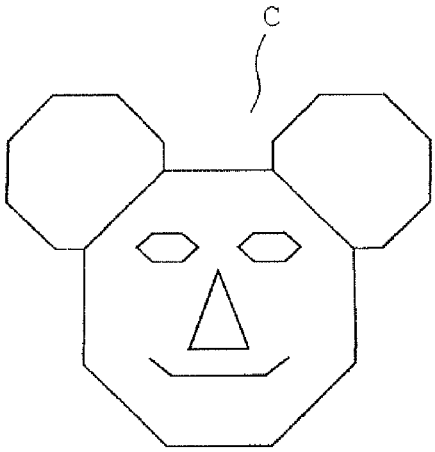
FIG. 22D is a plan view showing the outline cut out from the workpiece.

Thus, small holes H formed based on the primary and the secondary cut data collectively define a continuing cut that extends along the outline. As a result, character C can be cut out along the outline from workpiece C as shown in FIG. 22D. Workpiece W is cut apart only after the holing operation based on the secondary cut data has been executed. Thus, small holes H can be formed at their proper intended positions without misalignment before workpiece W is cut apart. Because small holes H are formed in a relatively greater size when the holing operation is executed based on the draw data as compared to holing operation executed based on the cut data, the draw operation is executed reliably without allowing workpiece W to be cut apart.

The above described fourth exemplary embodiment allows multi-needle embroidery sewing machine 1 to be utilized as a device to draw patterns on a sheet of workpiece W and as a device to cut workpiece W into the desired shape through formation of small holes H by applying punch needle 10. Because the above configuration does not require optional accessories such as cutter device or a separate cutting plotter, functional advantages offered by such additional devices can be achieved in less cost. The present exemplary embodiment further allows multi-needle embroidery sewing machine 1 to function as a punch data generator being subdivided into a draw data generator for generating the draw data and a cut data generator for generating the cut data. Such configuration advantageously allows generation of punch data that enables both drawing of the desired pattern on workpiece W and cutting of workpiece W along the outline of the drawn pattern.

The fourth exemplary embodiment further generates the cut data for cutting out the pattern along the outline through formation of consecutive small holes H in two different groups, the first group being the primary cut data and the second group being the secondary cut data. The primary cut data executes the holing operation while intermittently defining uncut portions free of small holes, whereas the secondary cut data executes the holing operation for the remaining punch dots after the execution of the holing operation based on the primary cut data. Because the cutting process is executed in two steps, the pattern can be neatly cut apart from workpiece W along the outline of the pattern drawn on workpiece W while preventing workpiece W from being misaligned or displaced when the first cut is made into workpiece W.

Figure 29A:
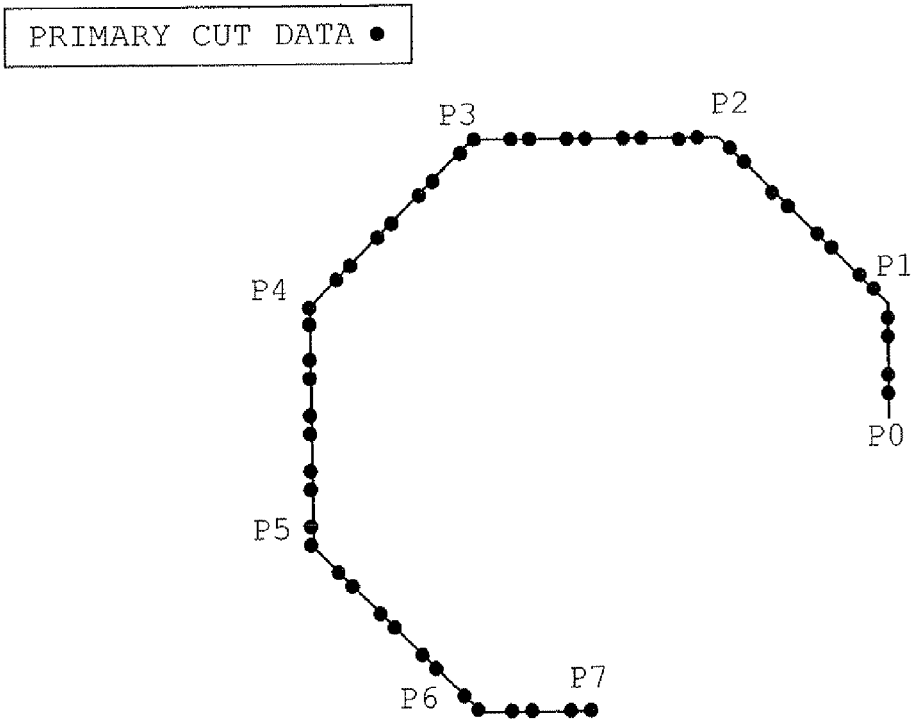
FIG. 29A corresponds to FIG. 28A and illustrates a fifth exemplary embodiment of the present disclosure.
Figure 29B:
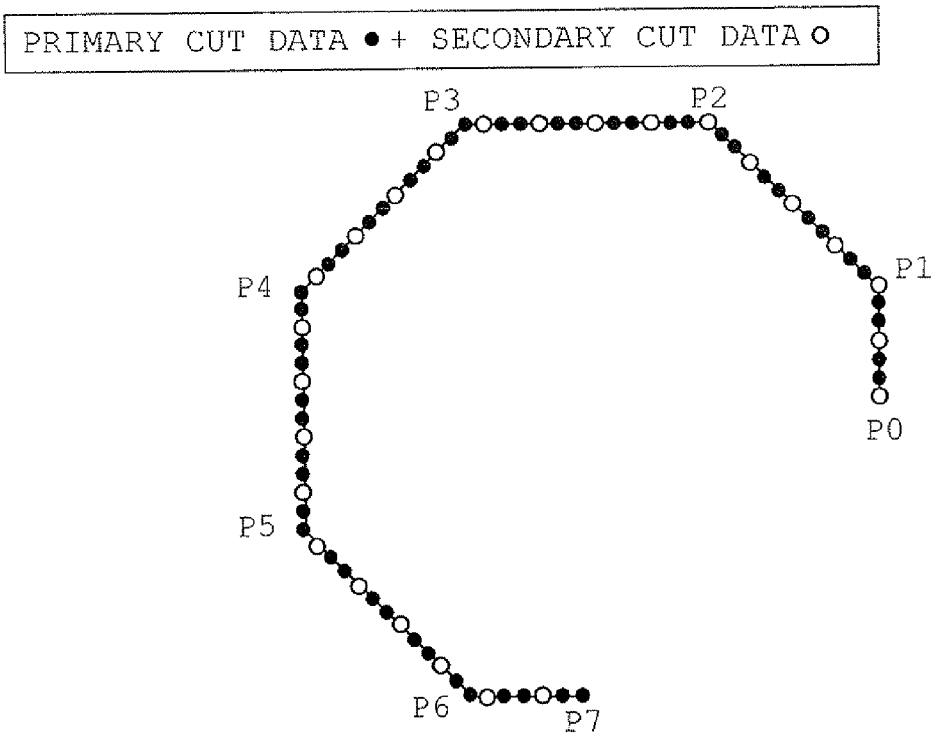
FIG. 29B corresponds to FIG. 28B.

A fifth exemplary embodiment of the present disclosure is illustrated in FIGS. 29A and 29B. The fifth exemplary embodiment differs from the fourth exemplary embodiment in how the cut data is grouped into the primary cut data and the secondary cut data. The fifth exemplary embodiment divides all the punch dots to be processed as the cut data into a unit of 3 consecutive punch dots overlying the outline. Among the 3 punch dots, a (one) punch dot represented as a white dot is grouped as the secondary cut data and the remaining 2 punch dots represented as black dots are grouped as the primary cut data. The above grouping process repeats itself. The above described configuration also yields the operation and effect similar to those of the fourth exemplary embodiment.

Figure 30:
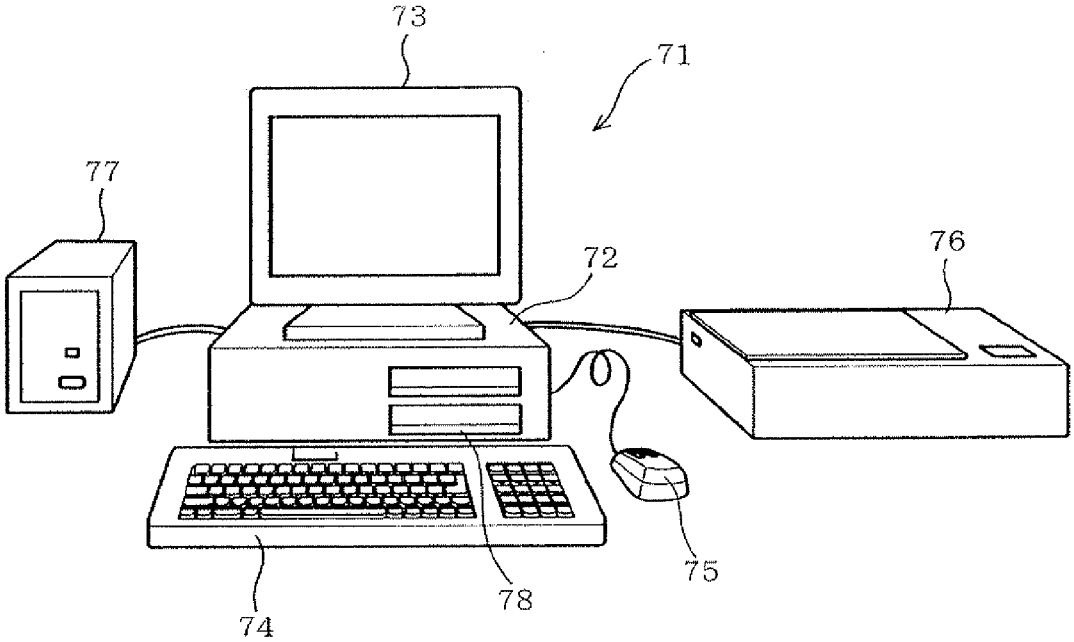
FIG. 30 illustrates a sixth exemplary embodiment of the present disclosure and is a general perspective view of a punch data generating device.

A sixth exemplary embodiment of the present disclosure is illustrated in FIG. 30 which shows the configuration of punch data generator 71. Punch data generator 71 is configured in the form of a readily available system such as a personal computer system constituting a device independent of multi-needle embroidery sewing machine 1. The punch data generated by punch data generator 71 is given to the multi-needle embroidery sewing machine 1. Punch data generator 71 is configured by interconnection of generator body 72, display 73 such as a color CRT (Cathode Ray Tube) display, keyboard 74, mouse 75, image scanner 76 capable of scanning color images, and external storage 77 such as a hard disc drive.

Generator body 72 comprises a main body of a personal computer including components not shown in detail such as CPU, ROM, RAM, I/O interface, and optical disc drive 78 that reads data from and writes data into medium such as CD (Compact Disc) and DVD (Digital Versatile Disc), or more generally, optical disc. Punch data generating program may be pre-stored, for instance, into external storage 77, or may be stored in computer readable medium such as CD and DVD which is placed into optical disc drive 78 to be loaded for execution.

The punch data generating program, when executed, displays information on to display 73 such as images of patterns for which the punch data is generated and mandatory information for generating the punch data. By referring to the information shown on display 73, the user makes necessary inputs and issues instructions through key board 74 and mouse 75 operation. Further, image scanner 76 allows scanning of image data of original images of patterns for which punch data generation is intended. As an alternative to taking in scanned images by image scanner 76, the digitalized photograph images may be taken in which was captured by digital cameras, etc.

Through execution of the punch data generating program, the generator body 72 generates the punch data for executing the holing operation using multi-needle embroidery sewing machine 1 based on image data of original images of patterns scanned by the user through image scanner 76. The configuration according to the six exemplary embodiment allows generator body 72 to function as both a draw data generator for generating the draw data and a cut data generator for generating the cut data. Generator body 72 may be further configured to function also as a data divider that divides the cut data into groups of the primary cut data and the secondary cut data.

Figure 31:
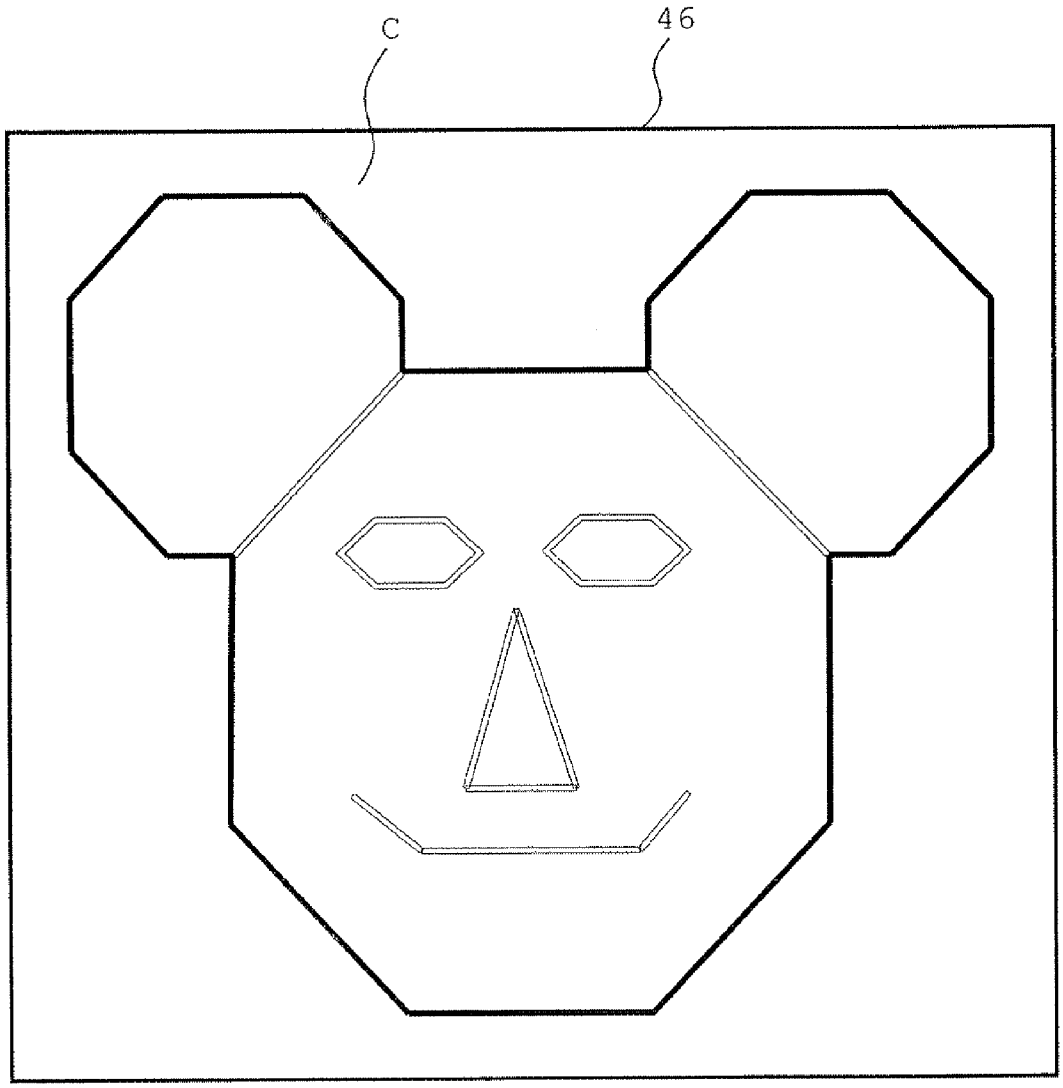
FIG. 31 illustrates a seventh exemplary embodiment of the present disclosure and corresponds to FIG. 10.

A seventh exemplary embodiment of the present disclosure is illustrated in FIG. 31 which illustrates a variation of the image displayed on LCD 46 during the punch data generation process. To elaborate, the screen on LCD 46 shows the image of character C formed by multiplicity of small holes H created on workpiece W in two different formats, the first format originating from image of patterns based on the draw data, whereas the second format originates from image of outlines based on the cut data. According to the seventh exemplary embodiment, the images of patterns based on the draw data and the images of outlines based on the cut data are displayed in different color. Such color variation provides improved visibility to allow the user to distinguish draw data from cut data.

Though not shown, the foregoing exemplary embodiments may be expanded or modified as required as follows.

In some of the foregoing exemplary embodiments, punch data generator was implemented as control circuit 41 provided in multi-needle embroidery sewing machine 1 and in one exemplary embodiment, the punch data generator was configured as a generally available system typically embodied as a personal computer. Alternatively, the punch data generator may be configured as a device connected directly to the embroidery sewing machine or indirectly over a network. The punch data generator may be configured as a dedicated machine. Further, each of the foregoing exemplary embodiments was configured such that most of the tasks involved in the punch data generation was executed automatically by the computer. Alternatively, some of the tasks such as extraction of patterns and extraction lines constituting the outlines from the image data; specification of pattern types; and determining the sequence of holing operation may be relied on the user's manual input.

In the fourth and the fifth exemplary embodiment, the data divider has been configured to repeat the process of grouping N number of punch dots into the secondary cut data comprising a predetermined M number of punch dots and into the primary cut data comprising the remaining (N−M) number of dots. An alternative approach may be taken in grouping the cut data in which a number of punch dots; for instance, 3 punch dots located at the adjoining portion of the adjacent lines, or at the corner formed by the adjacent lines are grouped as the secondary cut data and the rest of the punch dots as the primary data. If the length of the line is greater than a predetermined length, the secondary cut data may be inserted somewhere along the length of the line. Many such approaches may be employed alternatively.

Further, in the fourth and the fifth exemplary embodiment, generation of the draw data is not mandatory. Patterns may be printed or hand drawn and the outline of the pattern may be cut out by the holing operation based on the cut data. After cutting out the pattern along the outline, the user may make further modifications such as adding more hand drawn patterns or adding colors to the patterns. Stated differently, embroidery sewing machine can be utilized only as cutter for cutting the sheet of workpiece into a predetermined pattern in addition to its inherent functionality.

As one may readily appreciate, the present disclosure is applicable to various types of embroidery sewing machines. For instance, the number of needle bars 8 provided in needle bar case 7 may vary such as 9 or 12 and even 1, since holing operation is possible by replacing the sewing needle with a punch needle. Various modifications are allowable throughout the configuration of multi-needle sewing machine 1, such as transfer mechanism 18, carriage 19, and holder 21 as long as they are true to the spirit of the present disclosure.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A punch data generating device that generates punch data for execution with an embroiderable sewing machine, the embroiderable sewing machine including a needle bar that is configured to allow attachment of a punch needle for forming a plurality of small holes on a sheet of workpiece by piercing the workpiece in dot-by-dot strokes of the punch needle, and a transfer mechanism that is configured to transfer the workpiece in two predetermined directions in coordination with an up and down movement of the punch needle to execute a holing operation for forming the small holes on the workpiece, the punch data generating device, comprising:

a cut data generator that generates cut data constituting the punch data, the cut data being configured to instruct consecutive formation of the small holes at least along an outline of a pattern section of the workpiece in which a predetermined pattern is drawn to allow cutting of the outline;

a draw data generator that generates draw data constituting the punch data, the draw data being configured to instruct formation of the small holes on the pattern section of the workpiece to draw the predetermined pattern on the workpiece, wherein the cut data generator generates the cut data so as to instruct formation of the small holes on the workpiece at a first pitch and the draw data generator generates the draw data so as to instruct formation of the small holes at a second pitch, the first pitch being less than the second pitch.

2. The device according to claim 1 wherein the punch needle comprises a draw punch needle that is configured to draw the predetermined pattern by the formation of the small holes on the workpiece and a cut punch needle that is configured to form the small holes on the workpiece greater in size than the small holes formed on the workpiece by the draw punch needle, wherein the draw data generator generates the draw data that instructs execution of the holing operation with the draw punch needle and the cut data generator generates the cut data that instructs execution of the holing operation with the cut punch needle.

3. The device according to claim 1, further comprising a display capable of presenting images of the small holes to be formed on the workpiece based on the punch data, wherein the display presents an image of the predetermined pattern based on the draw data and an image of the outline based on the cut data in different representations.

4. The device according to claim 1, further comprising a data divider that divides all punch dots pertaining to the cut data into primary cut data that instructs execution of the holing operation for forming the small holes such that an uncut portion being free of the small holes is defined intermittently on the outline to prevent the outline from being cut out from the workpiece and into secondary cut data that instructs execution of the holing operation for forming the small holes on the uncut portion after the execution of the holing operation based on the primary cut data.

5. The device according to claim 4, further comprising a draw data generator that generates draw data constituting the punch data, the draw data configured to instruct formation of the small holes on the pattern section of the workpiece to draw the predetermined pattern on the workpiece, wherein the holing operation based on the draw data is executed prior to the holing operation based on the secondary cut data.

6. The device according to claim 4, wherein the data divider divides all punch dots pertaining to the cut data into the primary cut data and the secondary cut data by repeating:

grouping the punch dots into a unit of predetermined consecutive N number of punch dots residing along the outline, where N is equal to or greater than 2;

designating, among the N number of punch dots, a predetermined M number of punch dots, where M is less than N, as the secondary cut data, and designating remaining punch dots as the primary cut data.

7. A non-transitory computer readable medium storing a punch data generating program that generates punch data for execution with an embroiderable sewing machine, the embroiderable sewing machine including a needle bar that is configured to allow allowing attachment of a punch needle for forming a plurality of small holes on a sheet of workpiece by piercing the workpiece in dot-by-dot strokes of the punch needle, and a transfer mechanism that is configured to transfer the workpiece in two predetermined directions in coordination with an up and down movement of the punch needle to execute a holing operation for forming the small holes on the workpiece, the punch data generating program stored in the computer readable medium, comprising:

instructions for generating cut data constituting the punch data, the cut data being configured to instruct consecutive formation of the small holes at least along an outline of a pattern section of the workpiece in which a predetermined pattern is drawn to allow cutting of the outline;

instructions for generating draw data constituting the punch data, the draw data configured to instruct formation of the small holes on the workpiece to draw the predetermined pattern on the workpiece; and instructions for generating cut data configured to instruct formation of the small holes on the workpiece at a first pitch and the draw data generator generates the draw data so as to instruct formation of the small holes at a second pitch, the first pitch being less than the second pitch.

8. The computer readable medium according to claim 7, further comprising instructions for dividing all punch dots pertaining to the cut data into primary cut data that instructs execution of the holing operation for forming the small holes such that an uncut portion being free of the small holes is defined intermittently on the outline to prevent the outline from being cut out from the workpiece and into secondary cut data that instructs execution of the holing operation for forming the small holes on the uncut portion after the execution of the holing operation based on the primary cut data.

* * * * *